US005842363A

United States Patent [19]

Hattori et al.

[11] Patent Number: 5,842,363

[45] Date of Patent: Dec. 1, 1998

[54] PRODUCTION METHOD AND APPARATUS FOR DOUBLE CURVE FORMED PRODUCTS

[75] Inventors: Ichiro Hattori; Michio Aoki; Yoshihide Sakaguchi; Yoshihiro Hayashi; Masayasu Koshigoe, all of Aichi-ken, Japan

[73] Assignee: Kabushiki Kaisha Tokai-Rika-Denki-Seisakusho, Aichi-ken, Japan

[21] Appl. No.: 807,005

[22] Filed: Feb. 26, 1997

[30] Foreign Application Priority Data

Mar. 1, 1996 [JP] Japan ..... 8-045187
May 13, 1996 [JP] Japan ..... 8-117946

[51] Int. Cl.[6] ..... B21B 39/02

[52] U.S. Cl. ..... 72/133

[58] Field of Search ..... 72/127, 133, 135, 72/137, 146, 147, 338, 371, 379.2, 406

[56] References Cited

U.S. PATENT DOCUMENTS

| | | | |
|---|---|---|---|
| 533,513 | 2/1895 | Weed | 72/147 |
| 560,239 | 5/1896 | Stewart | 72/147 |
| 1,790,218 | 1/1931 | Appleby | 72/146 |
| 3,332,267 | 7/1967 | Allison | 72/147 |

*Primary Examiner*—Joseph J. Hail, III
*Assistant Examiner*—Rodney Butler
*Attorney, Agent, or Firm*—Sixbey Friedman Leedom & Ferguson; Thomas W. Cole

[57] ABSTRACT

The present invention provides a production method and an apparatus for double curve formed products for producing double curve formed products easily at low cost, stabilizing an accuracy in configurational dimension of the double curve formed product and improving an accuracy in assembly thereof, the production apparatus being of a simple construction apparatus. Around an inner die in which an end portion of a treatment product is engaged, an outer die in which the other end portion of the treatment product is engaged is rotated relative to each other at predetermined angles. At this time, a side face of the treatment product is curved so that it is successively folded back. By a deformation reaction caused at this time, the side face of this curved portion is pressed against a processing curved surface of the inner die such that the side face is deformed along the processing curved surface. Another side face of the treatment product is pressed against a processing curved surface of the outer die such that it is deformed along the processing curved surface. As a result, in the treatment product, one curved surface is formed along the processing curved surface of the outer die and the other curved surface which is continuous from the one curved surface which is folded back is formed along the processing curved surface of the inner die.

12 Claims, 25 Drawing Sheets

PRODUCTION METHOD AND APPARATUS FOR DOUBLE CURVE FORMED PRODUCTS

BACKGROUND OF THE INVENTION

1. Field of the Invention

This invention relates to a production method and an apparatus for double curve formed products in which an internal curved portion thereof and an external curved portion thereof are connected with each other integrally at one end and have a separating distance therebetween.

2. Description of the Related Art

When curved thick parts (e.g. EA plates 9) having double curves formed such that two curved portions which are connected by a folded back portion therebetween so as to be continuous with each other partially overlap each other with a separating distance therebetween as shown in FIG. 16 are manufactured, so-called a multi-forming press apparatus must be utilized. Processing by this multi-forming press apparatus requires materials which are treatment products 10 having a large thickness and rectangular and flat shape as shown in FIGS. 12–15 to be prepared.

Next, as shown in FIG. 12, this treatment product 10 is placed on a base tool 12 with one end side of the treatment product 10 being flush with one end side of the base tool 12. This base tool 12 is constructed in a stand-like form in which a curved processing surface 14 having a semi-circular shape in side surface is formed.

Next, as shown in FIG. 13, a first movable tool 11 is pressed against the treatment product 10. The treatment product 10 is nipped between a bottom face of the first movable tool 11 and pressing surfaces 13 located on both sides of the curved processing surface 14 in the base tool 12 such that the other end portion of the treatment product 10 extends from a gripping between the base tool 12 and the first movable tool 11 by a predetermined length.

A concave shaped processing curved surface 16 is formed on a side portion in the first movable tool 11 corresponding to the end portion from which the treatment product 10 extends. Next, a second movable tool 15 is pressed against the end portion from which the treatment product 10 extends from a side in which the base tool 12 is located. Then, this end portion is pressed such that it is nipped between a processing curved surface 17 of the second movable tool 15 and the processing curved surface 16 of the first movable tool 11 to bend the extending portion of the treatment product 10 substantially at right angle toward the first movable tool 11. After that, the second movable tool 15 is separated.

Next, as shown in FIG. 14, a processing curved surface head portion 19 of a third movable tool 18 is pressed against the bent extending portion of the treatment product 10 from obliquely above the first movable tool 11. Then, the bent extending portion is pressed such that it is nipped between the processing curved surface 16 and the processing curved surface head portion 19 to form an engaging portion 20 and a folded back portion 21 in the treatment product 10. After that, the third movable tool 18 is separated.

Next, the first movable tool 11 is separated from the treatment product 10 and a fourth movable tool 22 is set onto the treatment product 10. An external processing curved surface 23 corresponding to the curved processing surface 14 of the base tool 12 and a bending portion 24 for forming bending angles for the engaging portion 20 and the folded back portion 21 are formed on the fourth movable tool 22. The curved processing surface 14 of the base tool 12 is moved so as to be pressed against the external processing curved surface 23 of the fourth movable tool 22 in which the treatment product 10 is set. The treatment product 10 is pressed such that a corresponding portion of the treatment product 10 is nipped between the curved processing surface 14 and the external processing curved surface 23 to form a semi-circular shaped curved portion in the treatment product 10.

Successively, a fifth movable tool 25 is pressed against a portion of the treatment product 10 located above the bending portion 24 (see FIG. 15) from above the fourth movable tool 22.

Then, that portion is pressed such that it is nipped between a processing curved surface head portion 26 and the bending portion 24 to form the engaging portion 20 and the folded back portion 21 in predetermined shapes.

Next, the fourth movable tool 22 and the fifth movable tool 25 are separated from the treatment product 10. Consequently, a completed product of the treatment product 10 having double curves formed such that two curved portions which are connected by a folded back portion therebetween so as to be continuous with each other partially overlap each other with a separating distance therebetween as shown in FIG. 15 can be obtained.

Therefore, manufacturing of the double curve formed products according to the conventional multi-forming press production method as described above requires a large number of tools such as the first movable tool 11, the base tool 12, the second movable tool 15, the third movable tool 18, the fourth movable tool 22, and the fifth movable tool 25 to be prepared in the production apparatus. Thus, this method has such a problem that a large amount of cost is needed for manufacturing of such various tools and therefore production cost increases thereby raising the price of the completed products.

In the multi-forming press production apparatus, the first movable tool 11, the base tool 12, the second movable tool 15, the third movable tool 18, the fourth movable tool 22 and the fifth movable tool must be moved to their predetermined positions from various directions to set a required production condition. Thus, a plurality of movable control apparatuses for those tools must be distributed around the treatment product Therefore, this method has such a problem that the multi-forming press production apparatus becomes large in size so that a structure thereof becomes complicated, thereby increasing prices of the multi-forming press, leading to increased prices of the completed products.

Further, a number of processing steps increases because the double curve formed products of the treatment products 10 must be formed through a plurality of production steps. In the respective steps, the first movable tool 11, the base tool 12, the second movable tool 15, the third movable tool 18, the fourth movable tool 22, and the fifth movable tool 25 must be moved and set to each of their production positions and removed therefrom. Thus, this method has such a problem that a number of production steps increases and the operation of this system becomes complicated, thereby requiring time and labor for the production, leading to increased production cost.

If the double curve formed products of the treatment products 10 are manufactured through a number of tools and production steps, errors in production are accumulated so that a large error in configurational dimension of products is likely to be produced.

SUMMARY OF THE INVENTION

Accordingly, an object of the present invention is to provide a production method and an apparatus having a small number of production steps and a simple construction, capable of producing double curve formed products easily at low cost, stabilizing an accuracy in configurational dimension of the products and improving an accuracy in assembly thereof.

According to a first aspect of the present invention, there is provided a production method for double curve formed products in which an internal curved portion thereof and an external curved portion thereof are connected with each other integrally at one end and have a separating distance therebetween, said production method comprising:

engaging one end portion of a sheet shaped treatment product with an inner die;

engaging the other end portion of said sheet shaped treatment product with an outer die which is rotated around said inner die relative thereto;

rotating said inner die and said outer die relative to each other at a predetermined angle with one end of said treatment product fed along a processing curved surface of said outer die, said treatment product being folded back successively from a middle portion thereof to form said internal curved portion along a processing curved surface of said inner die, said internal curved portion being disposed inside of said external curved portion along said outer die.

If the production method described above is utilized, it is possible to manufacture the double curve formed products with a treatment product taken in between an inner die and an outer die, through a small number of production steps in which the inner die and the outer die are only rotated relative to each other with simple actions.

According to a second aspect of the present invention, there is provided a production apparatus for double curve formed products in which an internal curved portion thereof and an external curved portion thereof are connected with each other integrally at one end and have a separating distance therebetween, said production apparatus comprising:

an inner die having an engaging portion for engaging an end portion of a sheet shaped treatment product, and an external processing curved surface provided on an external circumferential surface portion continuous from said engaging portion;

an outer die having an engaging portion for engaging the other end portion of said treatment product, and an internal processing curved surface provided on an internal circumferential surface portion continuous from said engaging portion, said outer die being mounted rotatably out of said inner die; and a rotation driving means for rotating said inner die in which said one end of said treatment product is engaged and said outer die in which said other end portion of said treatment product is engaged, relative to each other in such a direction that a middle portion of said treatment product is folded back, to plastically deform said middle portion of said treatment product so as to be along the processing curved surface of said inner die.

If the construction described above is utilized, it is possible to manufacture the double curve formed products in which a curved surface corresponding to an external circumferential processing curved surface of the inner die and a curved surface corresponding to an internal circumferential processing curved surface of the outer die are formed in the treatment product at the same time by rotating the inner die and the outer die relative to each other with the treatment product taken in between the inner die and the outer die.

According to a third aspect of the present invention, there is provided a production apparatus for double curve formed products in which an internal curved portion thereof and an external curved portion thereof are connected with each other integrally at one end and have a separating distance therebetween, said production apparatus comprising:

an inner die in which an engaging portion for engaging an end portion of a treatment product formed in a circular sheet shape is provided in a part of an external circumferential surface which serves for a processing curved surface for said treatment product;

an outer die in which an engaging portion for engaging the other end portion of said treatment product is provided in a part of an internal circumferential surface which serves for a processing curved surface for said treatment product, said outer die being mounted out of said inner die rotatably therearound coaxially with said inner die; and a rotation driving means for rotating said outer die in which said other end portion of said treatment product is engaged, with respect to said inner die in which said one end of said treatment product is engaged, in such a direction that a middle portion of said treatment product is folded back, to plastically deform said treatment product so as to be along the processing curved surface of said inner die.

If the construction described above is utilized, it is possible to manufacture the double curve formed products in which a circular shaped curved surface corresponding to a circular shaped external circumferential processing curved surface of the inner die and a circular shaped curved surface corresponding to a circular shaped internal circumferential processing curved surface of the outer die coaxial therewith are formed in the treatment product at the same time by plastic deformation by rotating the inner die and the outer die relative to each other with the treatment product set in between the inner die and the outer die.

According to a fourth aspect of the present invention, there is provided a production method for double curve formed products, comprising:

a first step in which a front end of a sheet material is inserted into an engaging groove in a shaft inserted so as to form an annular cavity portion in a cylindrical body in which a slit opening is formed on a side face thereof, through said slit opening, and engaged with said engaging groove;

a second step in which said cylindrical body and said shaft are rotated relative to each other in a single direction until a rear end of said sheet material is engaged with an engaging portion formed in an internal circumferential surface of said cylindrical body; and a third step in which said cylindrical body and said shaft are rotated relative to each other in the other direction.

According to an invention of the fourth aspect, a front end of a sheet material is inserted through a slit opening formed in a cylindrical body and engaged with an engaging groove in a shaft inserted so as to form an annular cavity portion in the cylindrical body in which the slit opening is formed on a side thereof, in a first step. Then, if the cylindrical body and the shaft are rotated relative to each other by a predetermined amount of rotation in a single direction, the sheet material is pulled into the shaft, and bent along the internal circumferential wall of the cylindrical body so that it is curved in a substantially semi-circular shape while a rear end portion thereof is engaged with an engaging portion formed in the internal circumferential wall of the cylindrical body, in a second step.

Next, if the cylindrical body and the shaft are rotated relative to each other by a predetermined amount in the other direction in a third step, a curved portion of a sheet material curved in substantially semi-circular shape is folded back and wound up around the shaft, so that the double curve formed product is manufactured.

Therefore, it is possible to manufacture such a bent product in which two curved surfaces are bent so as to overlap each other or so-called double curve formed product, only by engaging a front end portion of the sheet material with the shaft and then rotating the shaft and the cylindrical body relative to each other without use of special equipment and dies.

Further, if the cylindrical body and the shaft are utilized as completed products, a processed sheet material is assembled therewith as it is as a double curve formed product. Thus, there is no error in accuracy in assembly and functional property of the product is not affected.

According to an invention of the fourth aspect, with the cylindrical body fixed, the shaft is rotated by a predetermined amount and then with the shaft fixed, the cylindrical body is rotated by a predetermined amount in the same direction as that in which the shaft is rotated, the shaft and the cylindrical body are rotated relatively to opposite direction to each other step by step, so that the double curve formed product is formed.

According to the fourth aspect of the present invention, the shaft and the double curve formed product are removed from the cylindrical body after the third step. Then the removed shaft and sheet material processed so as to have double curves are loaded into the other cylindrical body or a cylindrical body which is a completed product having the same internal configuration as the previously mentioned cylindrical body, thereby improving an accuracy in assembly.

According to a fifth aspect of the present invention, there is provided a production apparatus for double curve formed products comprising a first rotating means for fixing or rotating a cylindrical body in which a slit opening is formed on a side thereof and a second rotating means for fixing or rotating a shaft inserted so as to form an annular cavity portion in said cylindrical body.

According to an invention of the fifth aspect, a front end of the sheet material is inserted through a slit opening formed in a side face of the cylindrical body with the shaft fixed and engaged with the engaging groove by the second rotating means. Then, the cylindrical body is fixed by the first rotating means and the shaft is rotated by the second rotating means. Consequently, the sheet material is pulled by the shaft, and bent along the internal circumferential wall of the cylindrical body so that it is curved in substantially semi-circular shape and the rear end portion thereof is engaged with an engaging portion formed in the internal circumferential wall of the cylindrical body.

Next, the shaft is fixed by the second rotating means and the first rotating means rotates the cylindrical body in the same direction as that of the rotation of the shaft. Consequently, the rear end portion of the sheet material curved in substantially semi-circular shape is pressed by the engaging portion and rotated together with the cylindrical body. As a result, the curved portion is folded back and wound up around the shaft, so that so-called double curve formed product is produced.

According to the fifth aspect of the present invention, if the first rotating means and the second rotating means are disposed corresponding to turning positions of the first turn table, it is possible to process the sheet material continuously by achieving an action in which the shaft is fixed and the front end portion of the sheet material is engaged with the shaft, an action in which the cylindrical body is fixed and the shaft is rotated, and an action in which the shaft is fixed and the cylindrical body is rotated at respective stop positions depending on the respective stop positions of the first turn table. Further, it is possible to achieve continuous bending operation with the first turn table being rotated by disposing the rotating means on the external peripheral portion of the first turn table at predetermined intervals.

According to a sixth aspect of the present invention, there is provided a production apparatus for the double curve formed products, comprising:

a second turn table which is disposed below said first turn table with an external peripheral portion thereof overlapping that of said first turn table;

cylindrical cases disposed on an external peripheral portion of said first turn table with a predetermined interval, having a slit opening on a side of said cylindrical cases;

a through portion drilled in said first turn table to communicate with a cavity portion in said cases, through which the shaft and the double curve formed product stored in the cases can pass to said second turn table;

a holding means provided on said second turn table, for holding a cylindrical body in which said shaft and said double curve formed product passed through said through hole are loaded; and a pressing means for pressing said shaft and said double curve formed product stored in said cases, into a cylindrical body held by said holding means.

According to an invention of the sixth aspect, a second turn table is disposed below the first turn table such that the external peripheral portion thereof overlaps that of the first turn table. This second turn table is provided with a holding means for holding the cylindrical body which is a product.

Cylindrical cases in which a slit opening is formed on a side face are disposed with a predetermined interval on the external peripheral portion of the first turn table. A through hole which communicates with a cavity portion in these cases is drilled in the first turn table, allowing the shaft and the bent sheet material (double curve formed product) stored in the cases to pass therethrough.

Then, the shaft and the double curve formed product are loaded into other cylindrical body held by the holding means from the through hole.

That is, if the first turn table is rotated so that the sheet materials are successively bent to produce the double curve formed products, the second rotating means is retracted and then the shaft and the double curve formed product are loaded along axial direction into the other cylindrical body held by the holding means through the through hole by a pressing means.

Therefore, by utilizing the cylindrical body which is a product and the cases for bending work having the same shape as the cylindrical body and a large strength, even if the strength of the cylindrical body which is a completed product is small, it is possible to assemble the double curve formed product having a high accuracy in configurational dimension.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

Embodiments of the present invention will be described in details with reference to the accompanying drawings.

Figure 1:
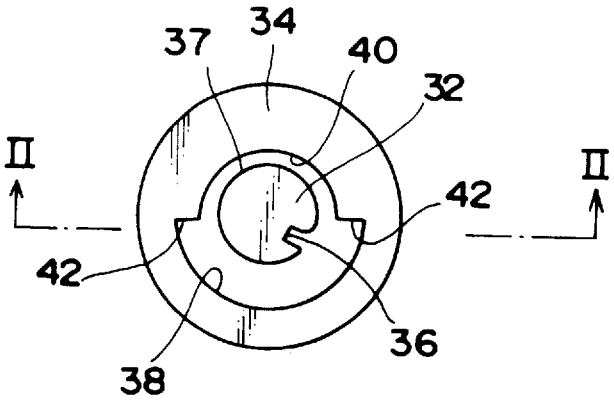
FIG. 1 is a front view showing major parts of a production apparatus for double curve formed products according to a first embodiment of the present invention.
Figure 2:
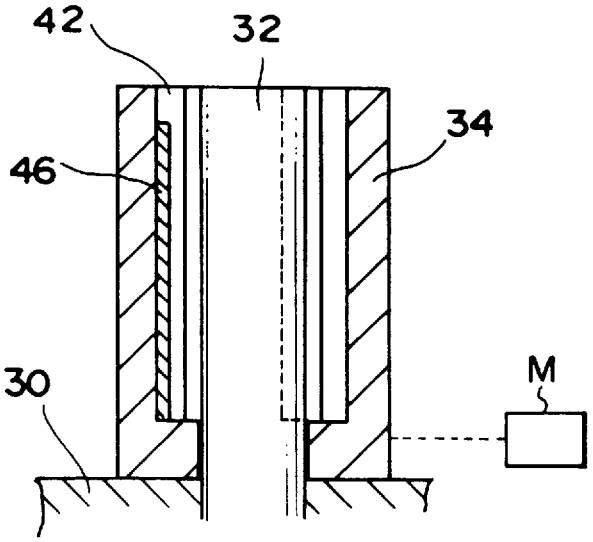
FIG. 2 is a sectional view taken along the lines II—II of FIG. 1.

As shown in FIGS. 1 and 2, production apparatuses for double curve formed products according to an embodiment of the present invention comprise an inner die 32 fixed to a base 30 and an outer die 34 rotatably mounted around a circumference of this inner die 32. This inner die 32 is a cylindrical member the beginning end of which is fixed to the base 30. A holding groove 36 having a substantially U-shaped cross section is formed at a predetermined position on the external circumference of the inner die 32 so as to run along an axial direction of the inner die 32.

The outer die 34 is formed in a substantially cylindrical shape, and a processing curved surface 38 which is a large-diameter semi-circular internal circumferential surface is formed on one portion of the outer die 34 divided by a plane section in diameter direction including the rotation central axis of the outer die 34. A small-diameter semi-circular surface 40 is formed on the other portion of the outer die 34. Then, engaging portions 42 are formed between both ends of the processing curved surface 38 and the semi-circular surface 40, the engaging portion 42 being formed in the outer die in a direction of radiation from the rotation central axis. A center of the semi-circular processing curved surface 38 of the outer die 34 formed in the above manner coincides with that of cylindrical inner die 32. Then, the outer die 34 is mounted so as to rotate around the center axis of the inner die 32. Further, the outer die 34 is rotated with respect to the center axis of the inner die 32 by means of a driving unit M schematically shown.

Figure 3A:
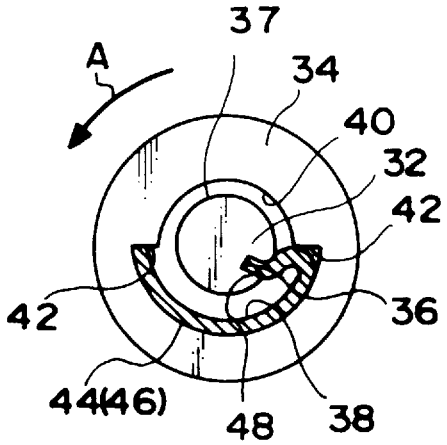
FIG. 3A is a longitudinal sectional view of major parts of the production apparatus showing a state in which processing of a treatment product is started in the production apparatus for the double curve formed products, according to the embodiment of the present invention.
Figure 3B:
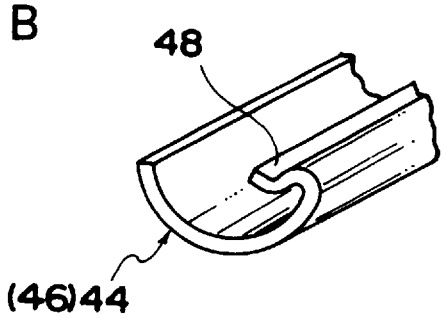
FIG. 3B is a perspective view of major part of the treatment product.
Figure 3C:
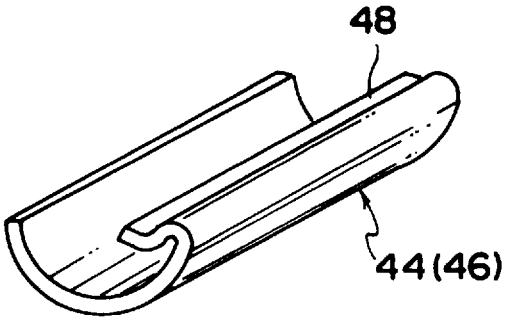
FIG. 3C is a perspective view of the treatment product.
Figure 6A:
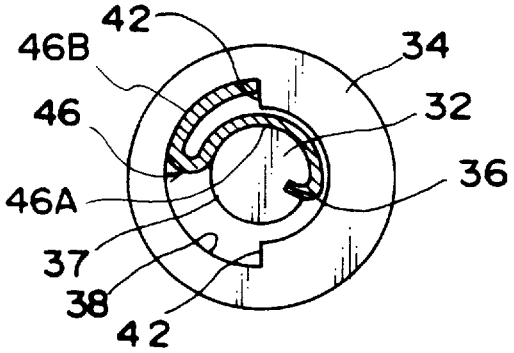
FIG. 6A is a longitudinal sectional view of major parts of the production apparatus showing a state in which processing of a treatment product is finished with the outer die turned at 270° in the production apparatus for the double curve formed products, according to the embodiment of the present invention.
Figure 6B:
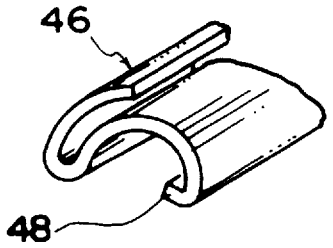
FIG. 6B is a perspective view of major part of the treatment product.
Figure 6C:
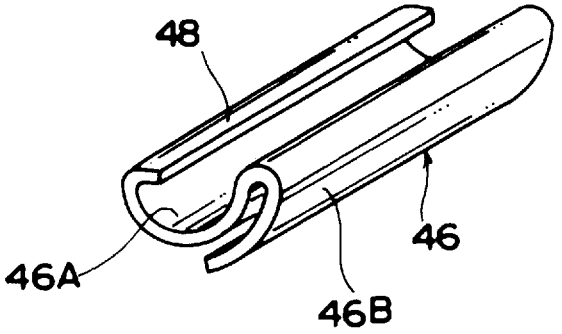
FIG. 6C is a perspective view of the treatment product.

The production apparatuses for the double curve formed products having the above construction process a semi-circular raw treated material shown in FIGS. 3A–3C to a complete double curve formed product shown in FIGS. 6A–6C by plastic deformation. This raw treated material 44 is formed by, as shown in FIGS. 3A–3C, processing a thick rectangular metallic material so as to be curved in a form of semi-circle by plastic deformation and bending one end of that curved portion along a diameter direction of that curved portion in inverse U-shaped cross section as viewed from a side thereof, so that an engaging portion 48 is formed which is a linear end portion extending in a direction of the diameter.

This raw treated material 44 is set in the production apparatus such that the engaging portion 48 is engaged with the holding groove 36 in the inner die 32 and a free end portion of the other side of the raw treated material 44 is engaged with the other engaging portion 42 in the outer die 34 while the external surface of the raw treated material 44 is in contact with the processing curved surface 38 of the outer die 34.

Figure 4A:
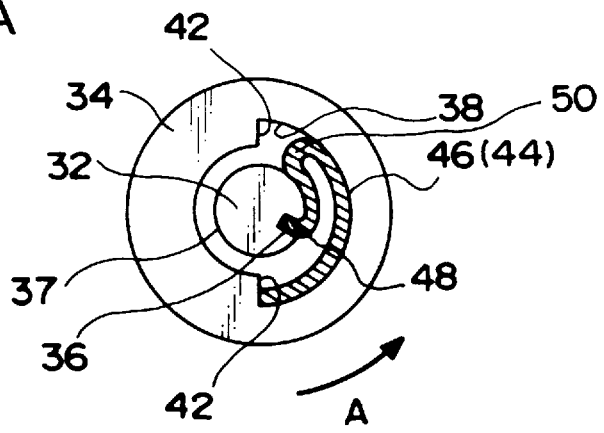
FIG. 4A is a longitudinal sectional view of major parts of the production apparatus showing a state of a treatment product being processed with the outer die turned at 90° in the production apparatus for the double curve formed products, according to the embodiment of the present invention.
Figure 4B:
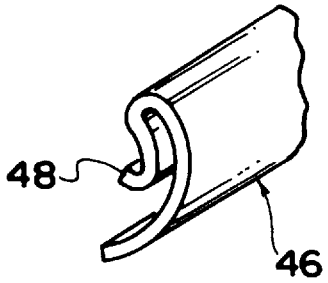
FIG. 4B is a perspective view of major part of the treatment product.
Figure 4C:
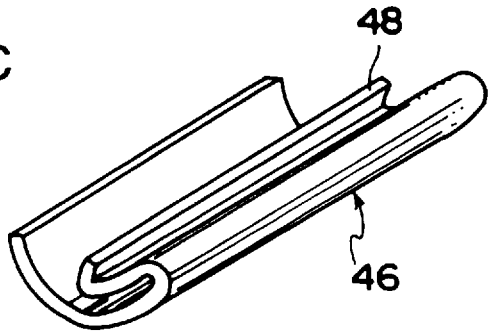
FIG. 4C is a perspective view of the treatment product.

Next, the outer die 34 is rotated in a direction of the arrow A shown in FIG. 3A by means of the driving unit M. Consequently, as shown in FIGS. 4A–4C, as the outer die 34 rotates in the direction of the arrow A, the raw treated material 44 is deformed so that the engaging portion 48 comes near the free end portion of the other side. That is, a middle portion of the raw treated material 44 which is formed so as to be folded back in the inverse U-shaped form near the engaging portion 48 is gradually bent and moved toward the other end portion thereof.

Figure 5A:
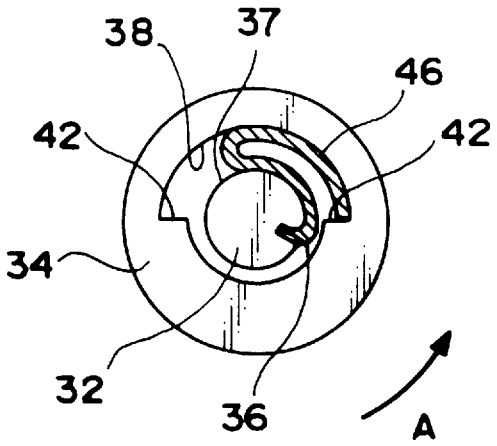
FIG. 5A is a longitudinal sectional view of major parts of the production apparatus showing a state of a treatment product being processed with the outer die turned at 180° in the production apparatus for the double curve formed products, according to the embodiment of the present invention.
Figure 5B:
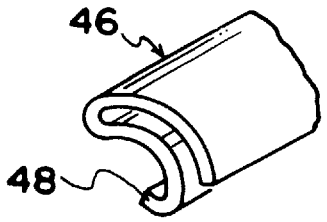
FIG. 5B is a perspective view of major part of the treatment product.
Figure 5C:
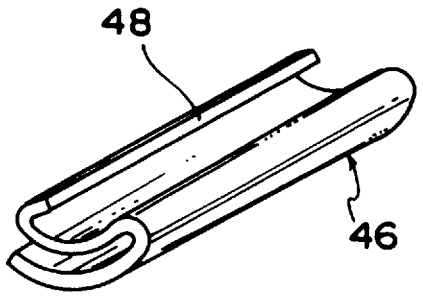
FIG. 5C is a perspective view of the treatment product.

When the bent portion 50 having an inverse U-shaped cross section is further bent so as to be folded back, a part of side portion of a treatment product 46 currently under processing is pressed against a processing curved surface 37 of the inner die 32 by deformation reaction and at the same time, the other part of the side portion of this treatment product is pressed against the processing curved surface 38 of the outer die 34, so that the side portion of the treatment product 46 contacting this processing curved surface 37 is plastically deformed so as to fit to the processing curved surfaces 37, 38. At the same time, the side of the other portion of the treatment product 46 is pressed against the processing curved surface 38 of the outer die 34 by deformation reaction of the bent portion 50 so as to be plastically deformed to fit to a shape of the processing curved surface 38. In this manner, the outer die 34 is rotated in the direction of the arrow A, that is, from its original position shown in FIG. 3A, to such a state in which it is rotated by 90° in the direction of the arrow A as shown in FIG. 4A, further to a state in which it is rotated by 180° in the direction of the arrow A as shown in FIG. 5A, and finally to a state in which it is rotated by 270° as shown in FIG. 6A. Consequently, the treatment product 46 is completed as a double curve formed product.

The treatment product 46 is produced so as to have an internal curved portion 46A which has a curved surface along an external circumference surface of the processing curved surface 37 of the inner die 32 from the engaging portion 48 and an external curved portion 46B formed by bending the treatment product from this internal curved portion 46A so as to be folded back in an inverse U-shaped form, the external circumferential surface of which has the same curvature as the processing curved portion 38 of the outer die 34. Consequently, double curved surfaces are formed integrally in this completed treatment product.

Because the treatment product is processed in such a single processing step in which the outer die 34 is only rotated around the center axis of the inner die 32, a processed configuration of a completed product of the treatment product 46 is always maintained so as to be equal. Thus, accuracy in processing can be stabilized and further the double curve formed products having the same configuration can be manufactured at a high accuracy. Further, because only the inner die 32 and the outer die 34 having a simple configuration are utilized as a production apparatus therefor, it is possible to produce the production apparatus at cheap prices. Thus, because mass production of the double curve formed products can be carried out with a simple production apparatus, a few processing steps and a quick production speed, prices of manufactured products can be reduced.

The production apparatuses for the double curve formed products having the above-described construction according to this embodiment are not restricted to the above-described construction, but may be configured with other various constructions. That is, it is permissible to so construct that the inner die 32 and the outer die 34 rotate with respect to each other instead of fixing the inner die 32 relative to the base 30. For example, the outer die 34 is fixed and the inner die 32 is constructed to be rotatable. It is needless to say that the inner die 32 and the outer die 34 may rotate in opposite directions to each other. Further, instead of forming the processing curved surface 37 of the inner die 32 into an arc form, it is permissible to form other curved surfaces. Further, it is needless to say that the processing curved surface 38 of the outer die 34 may be formed in other curved surfaces such as square pillar shape instead of circular shape. Still further, the internal curved portion and the external curved portion of the treatment product 46 are not limited to circular shape but may be polygonal curved portions such as an external faces of polygons.

Applications of the double curve formed products having the above-described construction will be described with reference to FIGS. 7–11.

The double curve formed products which are the treatment products 46 can be utilized as, for example, an energy absorbing plate (hereinafter referred to as EA plate) for absorbing energy in the webbing winding apparatus of automobile's seat belt equipment.

Figure 7:
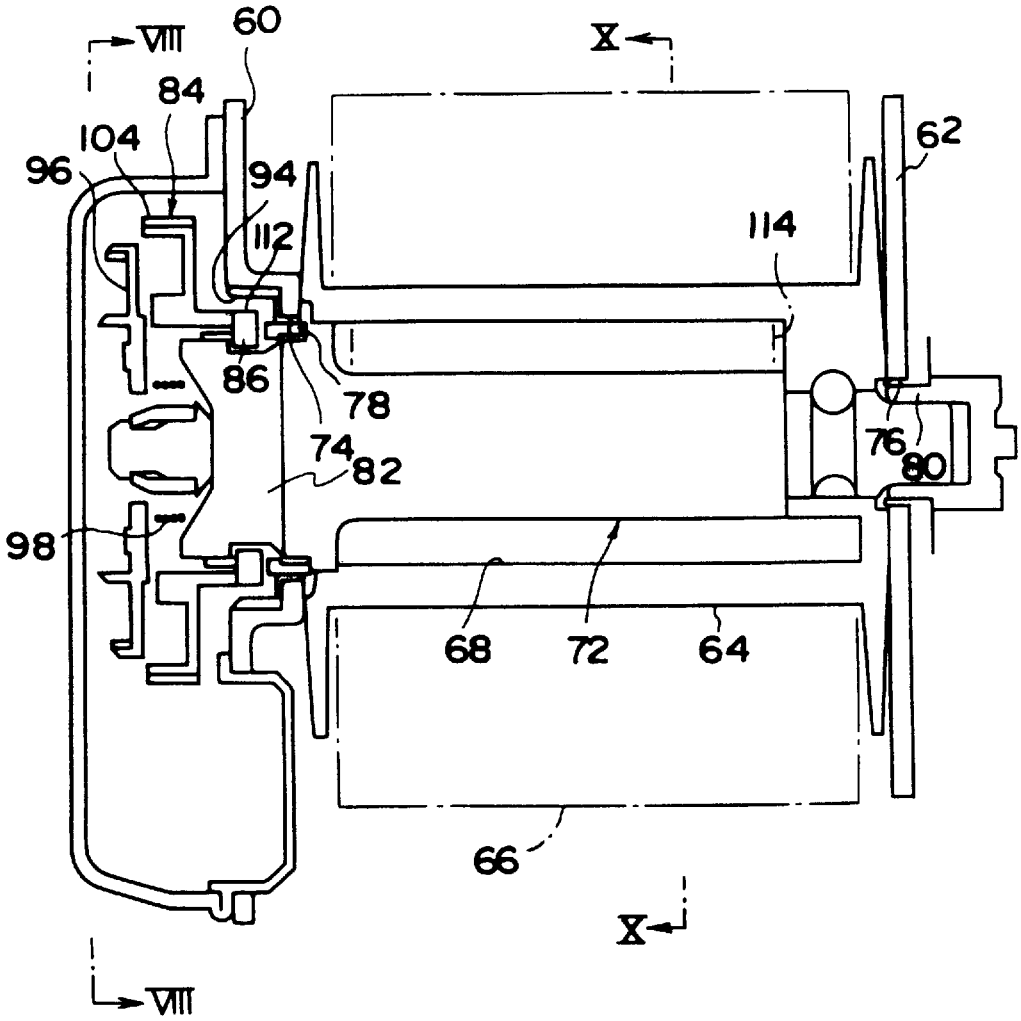
FIG. 7 is a schematic sectional view showing a construction of a webbing winding apparatus utilizing the double curve formed product of the present invention.
Figure 8:
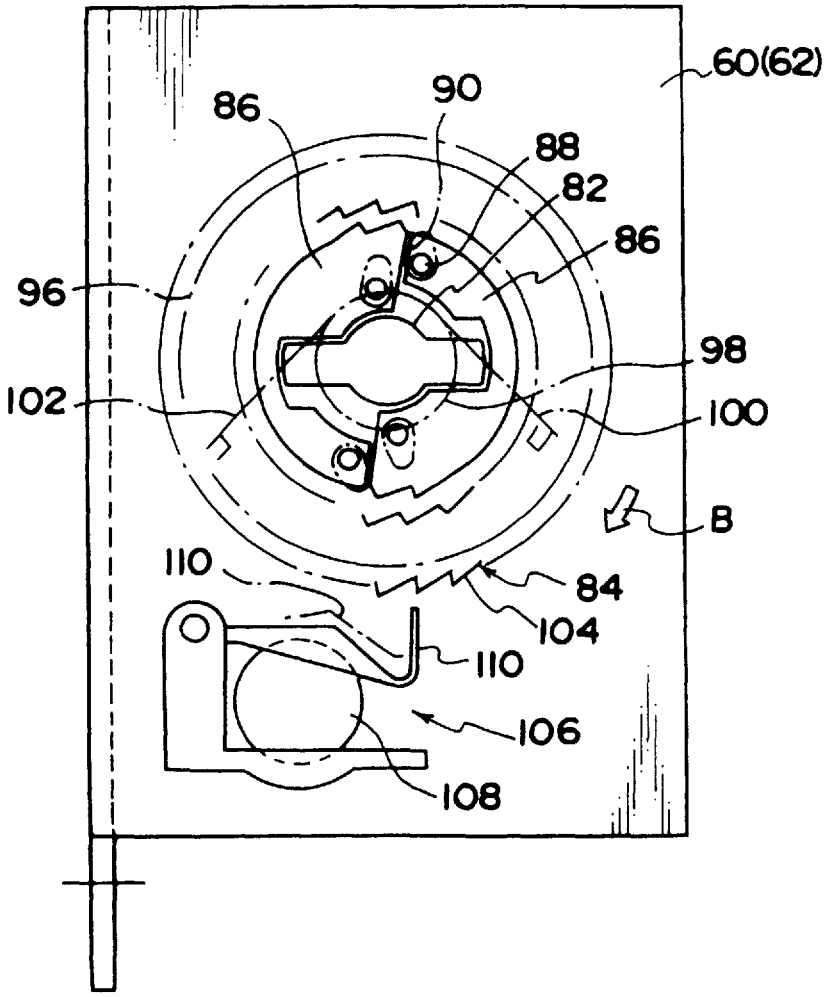
FIG. 8 is a longitudinal sectional view taken along the lines VIII—VIII of FIG. 7.

As shown in FIGS. 7–11, the webbing winding apparatus comprises a spool 64 between leg pieces 60 and 62 with an axis thereof coinciding with a direction in which the leg pieces 60, 62 opposite each other. An end of a webbing is fixed to the spool 64 such that the webbing 66 can be freely taken out and wound up relative to the spool 64 because of rotations of the spool 64. An arrow B indicates a direction of taking out the webbing 66. As shown in FIG. 7, an end of the webbing 66 is inserted into a webbing engaging groove 68 formed in the spool 64 from one direction, surrounds a webbing fixing shaft (fixing portion) 70 provided on the other side such that it is folded back and encounters the webbing 66 in the webbing engaging groove 68. Consequently, the webbing 66 is prevented from slipping out.

Figure 9:
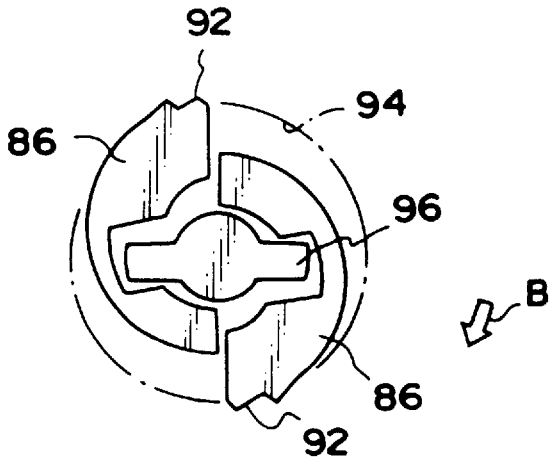
FIG. 9 is an explanatory view showing major parts of FIG. 8 showing a state in which the webbing winding apparatus utilizing the double curve formed product of the present invention is locked.

The spool 64 is of a cylindrical shape and a shaft 72 is provided coaxially with the spool 64. The shaft 72 supports the spool 64 such that the spool 64 is slidable on the shaft 72 with both ends thereof, making the spool 64 freely rotatable relative to each other. Both ends of the shaft 72 are supported through adapters 78, 80 within openings 74, 76 formed in the leg pieces 60, 62 respectively such that the shaft 72 is freely rotatable. A protruding shaft 82 is provided at one end of the shaft 72 so as to protrude through the opening 74 out of the leg piece 60, such that the protruding shaft 82 rotates integrally with the shaft 72. A V-gear 84 is engaged with the protruding shaft 82 such that the V-gear 84 is freely rotatable with respect to the shaft 72. A pair of lock plates 86 are disposed between the V-gear 84 and an end face of the shaft 72. Pins 88 and pin grooves 90 are formed between the lock plates 86 and the V-gear 84, such that the pins 88 are engaged with the pin grooves 90. Consequently, as shown in FIG. 9, the lock plates 86 can be moved to a direction of diameter expansion by rotations of the V-gear 84 relative to the shaft 72 in the direction of pulling out the webbing.

Lock pawls 92 are formed on external ends of the lock plates 86. Lock pawls which are internal teeth 94 are formed so as to oppose the lock pawls 92 on the leg piece 60 outside the opening 74 of the leg piece 60. The lock pawls 92 are engaged with the lock teeth 94 from their separating state by a movement of the lock plate 86 in the direction of diameter expansion, thereby preventing the shaft 72 from being rotated in the direction of pulling out the webbing. The lock pawls 92 and the lock teeth 94 construct a locking means.

A pressing plate 96 is engaged with a front end of the protruding shaft 82 such that the pressing plate 96 is rotated integrally with the shaft 72. A torsional coil spring 98 is engaged with the protruding shaft 82 between the pressing plate 96 and the V-gear 84 such that an end 100 of the torsional coil spring 98 is engaged with the V-gear 84 and the other end 102 thereof is engaged with the pressing plate 96. The torsional coil spring 98 urges the V-gear 84 so as to rotate the V-gear 84 integrally with the shaft 72.

V-teeth 104 which are external teeth are formed on an external circumferential face of the V-gear 84 and an acceleration sensor 106 is disposed on the leg piece 60 below the V-gear 84 so as to oppose the V-teeth 104. In the acceleration sensor 106, if an inertial ball 108 is moved in the forward direction of a vehicle due to the inertia by receiving an acceleration caused by a sudden deceleration of the vehicle, a V-pawl 110 is moved from the solid line position to the dotted line position in FIG. 8 so that the V-gear 84 is engaged with the V-teeth 104, thereby preventing the V-gear 84 from being rotated in the direction of pulling out the webbing.

The other end of the shaft 72 is protruded out of the leg piece 62 and a spiral spring (not shown) is provided at its protruding end such that the spiral spring urges the shaft 72 in the direction of winding up the webbing.

Figure 10:
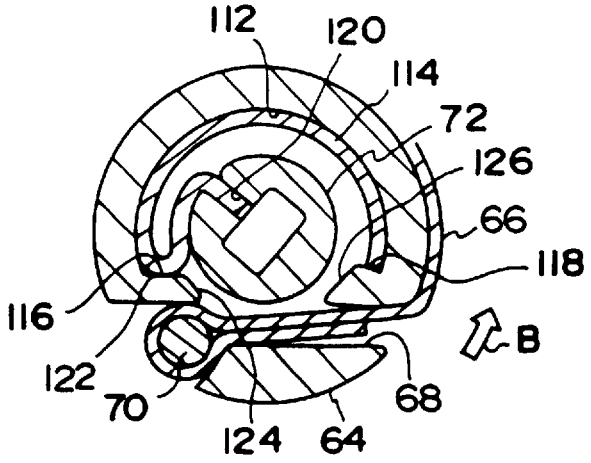
FIG. 10 is a longitudinal sectional view of major parts showing a cross section taken along the lines X—X of FIG. 7.

As shown in FIG. 10, a cavity portion 112 is formed between the spool 64 and the shaft 72, the cavity portion being shorter than an axial direction length of the spool 64 and extending in a predetermined angle range. An EA plate (energy absorbing member) 114 is formed in the cavity portion 112. Internal angle portions 116, 118 are formed at both ends in circumferential direction in the cavity portion 112. The EA plate 114 is formed in a double curve formed configuration. An end thereof is inserted and fixed in a plate fixing groove 120 formed in an external circumferential surface of the shaft 72, a middle portion thereof is bent in U-letter shape such that a bottom of the bent portion is in contact with the internal angle portion 122, and the other end thereof is disposed to contact the internal angle portion 118. A portion of one end side of the EA plate 114 is in contact with the external circumferential face of the shaft 72 and a portion of the other end side thereof is in contact with the internal circumferential face of the spool 64.

If a rotation of the shaft 72 in the direction of pulling out the webbing is blocked so that webbing tension gives a rotation force in the direction of pulling out the webbing to the spool 64 and the shaft 72, the other end of the EA plate 114 is pressed by the internal angle portion 118. Consequently, as the spool 64 rotates in the direction of pulling out the webbing (the direction of the arrow B) with respect to the shaft 72, the EA plate 114 is wound up around the external circumferential face of the EA plate 114 in the direction of pulling out the webbing. At this time, prior to the winding up, the EA plate 114 is mainly plastically deformed at the bent portion. A plastic deformation force required when the EA plate is plastically deformed is equal to a force obtained when mainly the spool 64 is rotated in the direction of pulling out the webbing with respect to the shaft 72.

If the rotation of the shaft 72 in the direction of pulling out the webbing is not blocked and therefore is free, the EA plate 114 maintains its original shape so that the spool 64 and the shaft 72 rotate integrally.

Figure 11:
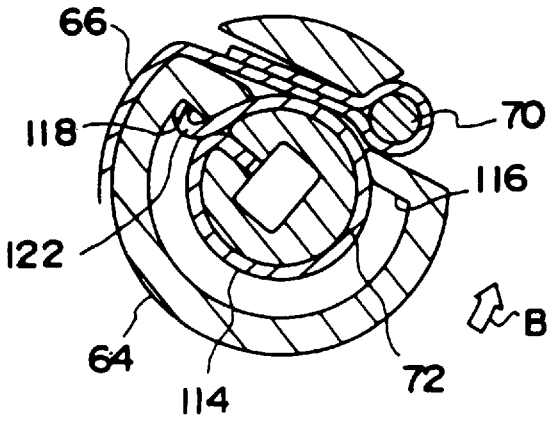
FIG. 11 is a longitudinal sectional view of major parts showing a cross section taken along the lines X—X of FIG. 7 showing a state after the double curve formed product in the webbing winding apparatus utilizing the double curve formed product of the present invention absorbs energy.
Figure 12:
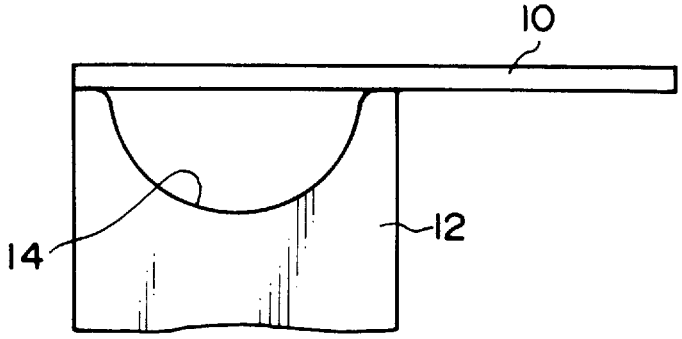
FIG. 12 PRIOR ART
FIG. 12 is an explanatory view of major parts showing processing of the double curve formed product by a conventional multi-forming press apparatus.
Figure 13:
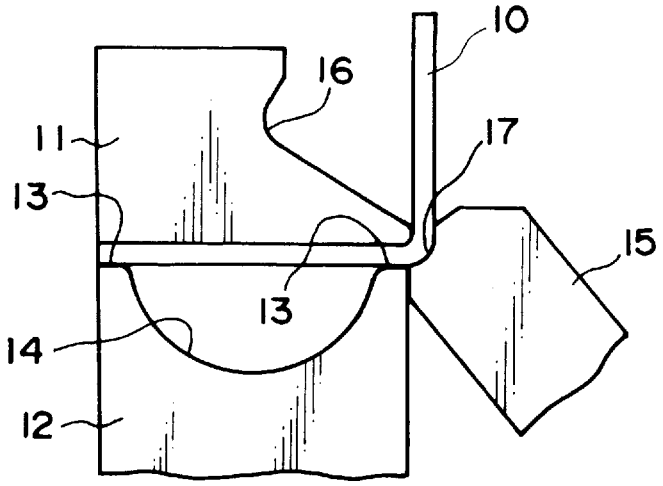
FIG. 13 PRIOR ART
FIG. 13 is an explanatory view showing a state in which the double curve formed product is being processed by a conventional multi-forming press apparatus.
Figure 14:
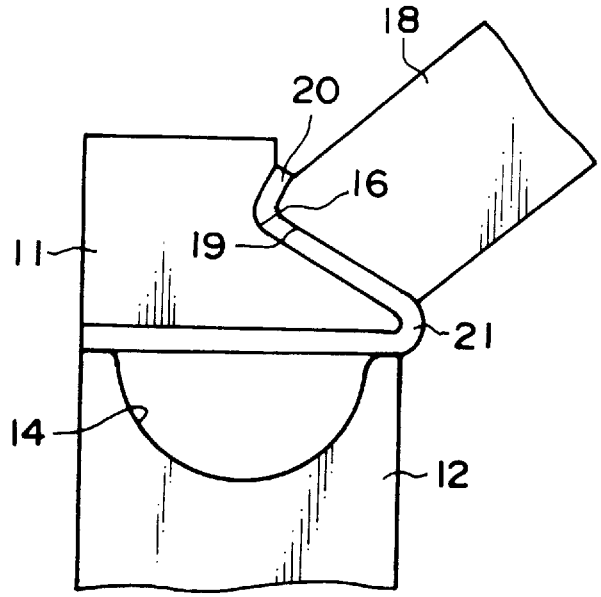
FIG. 14 PRIOR ART
FIG. 14 is an explanatory view showing a state in which the double curve formed product is being processed by a conventional multi-forming press apparatus.
Figure 15:
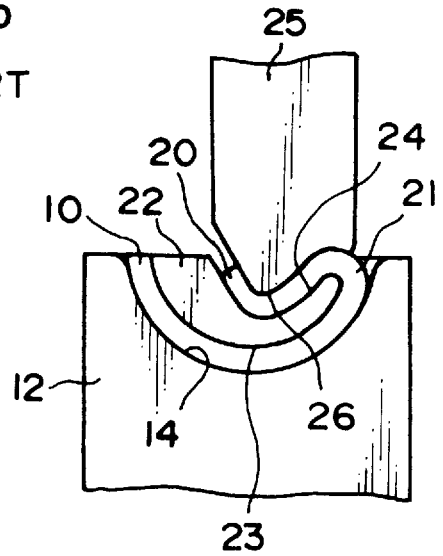
FIG. 15 PRIOR ART
FIG. 15 is an explanatory view showing a state after processing of the double curve formed product is finished by a conventional multi-forming press apparatus.
Figure 16:
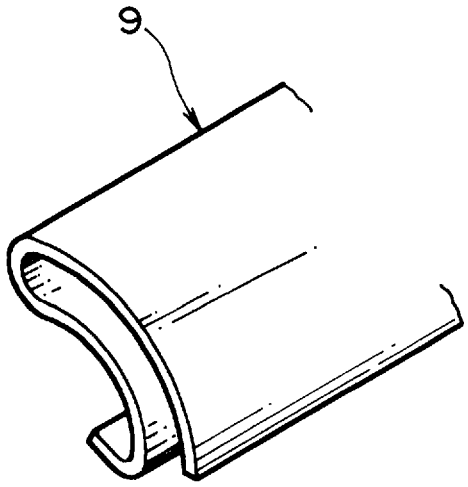
FIG. 16 PRIOR ART
FIG. 16 is a perspective view showing an EA plate.

Gaps between the internal angle portions 116, 118 and the shaft 72 are set to gaps (124, 126) equivalent to a thickness of a single sheet of the EA plate 114. If the EA plate 114 is wound around the external circumferential face of the shaft 72 by a single layer, as shown in FIG. 11, a portion of a winding beginning end of the EA plate 114 comes into contact with the other end portion of the EA plate 114. At this time, because the gap 126 between the internal angle portion 118 and the shaft 72 is only as small as the thickness of a single sheet of the EA plate 114, the winding beginning portion of the EA plate 114 is blocked by the other end portion of the EA plate 114 which has already entered into the gap 126 so that it cannot enter the gap 126. Thus, successive rotations of the spool 64 in the direction of pulling out the webbing relative to the shaft 72 is blocked. With this mechanism, a stopper means for limiting an amount of the rotation of the spool 64 in the direction of pulling out the webbing with respect to the shaft 72 is constructed.

Next, an operation of the above-described webbing winding apparatus will be described.

Usually, the EA plate 114 maintains its original configuration shown in FIG. 10 and the shaft 72 and the spool 64 rotate integrally with each other so that the webbing is pulled out or wound up freely.

At the time of sudden deceleration of a vehicle, if the lock pawl 92 is engaged with the lock teeth 94 so that the locking means is activated and then a rotation of the shaft 72 in the direction of pulling out the webbing is blocked, the pulling force of the webbing 66 gives a force for rotating the spool 64 in the direction of pulling out the webbing with respect to the shaft 72. Consequently, the EA plate 114 comes not to be able to maintain its original configuration so that it is deformed. With the rotation of the spool in the direction of pulling out the webbing with respect to the shaft 72, the EA plate 114 is pressed at the internal angle portion 118 of the spool 64 so that it is wound up around the external circumferential face of the shaft 72.

If the other end portion of the EA plate 114 is forced into the internal angle portion of the spool at the winding beginning end of the EA plate 114 around the shaft 72, successive rotations of the spool in the direction of pulling out the webbing with respect to the shaft is blocked so as to prevent the webbing from being father pulled out. Because the webbing 66 is pulled out by a predetermined length while the EA plate 114 is being plastically deformed, absorption of energy is achieved.

The production method and the production apparatus for the double curve formed products according to the present invention as described above produce such an excellent effect that the double curve formed products can be manufactured easily at low cost with such a production apparatus having a simple construction and a few processing steps.

Next, a production apparatus 230 according to a second embodiment of the present invention will be described.

Prior to that description, an energy absorption plate (hereinafter referred to as EA plate) which is a double curve formed product manufactured by means of the production apparatus for the double curve formed products according to the second embodiment of the present invention will be described. Meanwhile, this production apparatus is not restricted to processing of the EA plates but may be utilized for manufacturing of various types of the double curve formed products.

Figure 29:
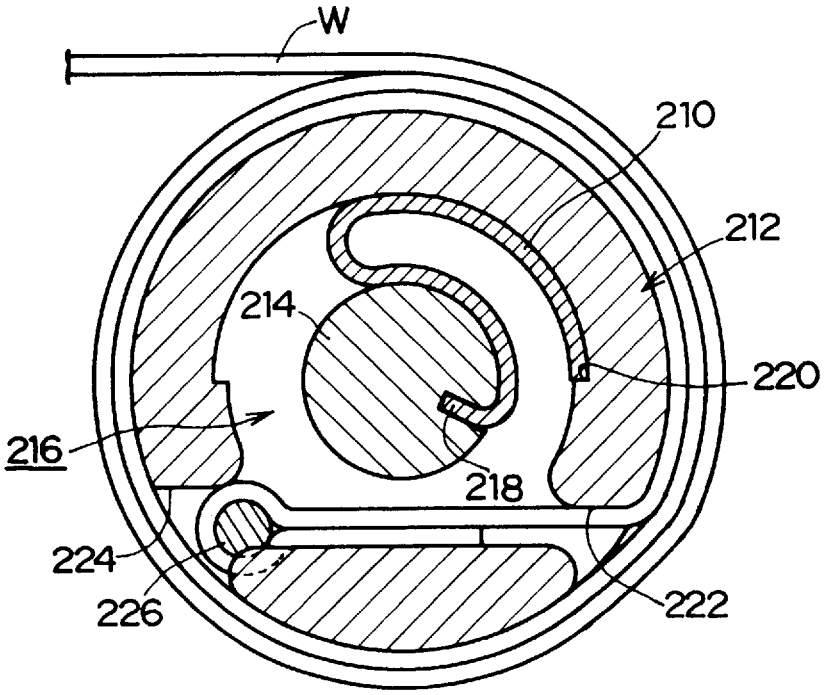
FIG. 29 is a sectional view for explaining a function of the EA plate.

As shown in FIG. 29, the EA plate 210 is disposed in a tubular cavity portion 216 formed between a spool 212 which is a cylindrical unit constituting a webbing winding apparatus and a shaft 214 which journals this spool 212 at both ends thereof.

The EA plate 210 is a thick metallic member bent so that two curved faces thereof overlap each other, and an end thereof is partially bent so as to follow an external circumferential face of the shaft 214 and fixed in an engaging groove 218. An internal curved portion of the EA plate 210 is in contact with the external circumferential face of the shaft 214 from this engaging groove 218 and folded back. An external curved portion which is curved up to the other end portion is in contact with the internal circumferential face of the spool 212 and the other end portion is in contact with an engaging portion 220 formed on an internal circumferential face of the spool 212.

Slit openings 222, 224 which communicate the cavity portion 216 with outside are formed in the spool 212 along an axial direction thereof. A winding end portion of webbing W is inserted through the slit opening 222 and wound up around a fixing shaft 226 provided in the slit opening 224 so that the webbing W is fixed to the spool 212. Then, the webbing W is wound up around the spool 212 with a position in the vicinity of the slit opening 222 as a beginning point. As the spool 212 rotates integrally with the shaft 214, the webbing W is pulled out or wound up.

Figure 30:
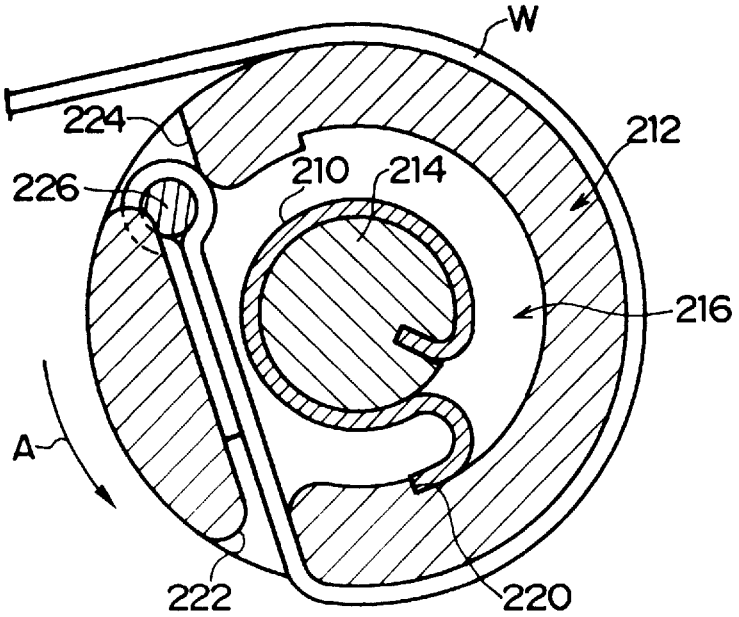
FIG. 30 is a sectional view for explaining a function of the EA plate.

With such a construction, if the locking means is activated when a vehicle is decelerated quickly and then a rotation of the shaft 214 is blocked thereby, the spool 212 is rotated in a direction of pulling out the webbing (direction of the arrow A) with respect to the shaft 214 by a tension of the webbing W. Consequently, as shown in FIG. 30, the other end portion is pressed by the engaging portion 220 so that the EA plate 210 becomes incapable of maintaining its original configuration and then is wound up around the external circumferential face of the shaft 214 and the other end portion is forced by the engaging portion 220. Successive rotations of the spool 212 with respect to the shaft 214 are blocked so that the pulling out of the webbing W is stopped. In such a process in which the EA plate 210 is plastically deformed as described above, energy applied to the webbing W is absorbed.

Next, a production apparatus 230 for producing the EA plates 210 according to the second embodiment will be described below.

Figure 17:
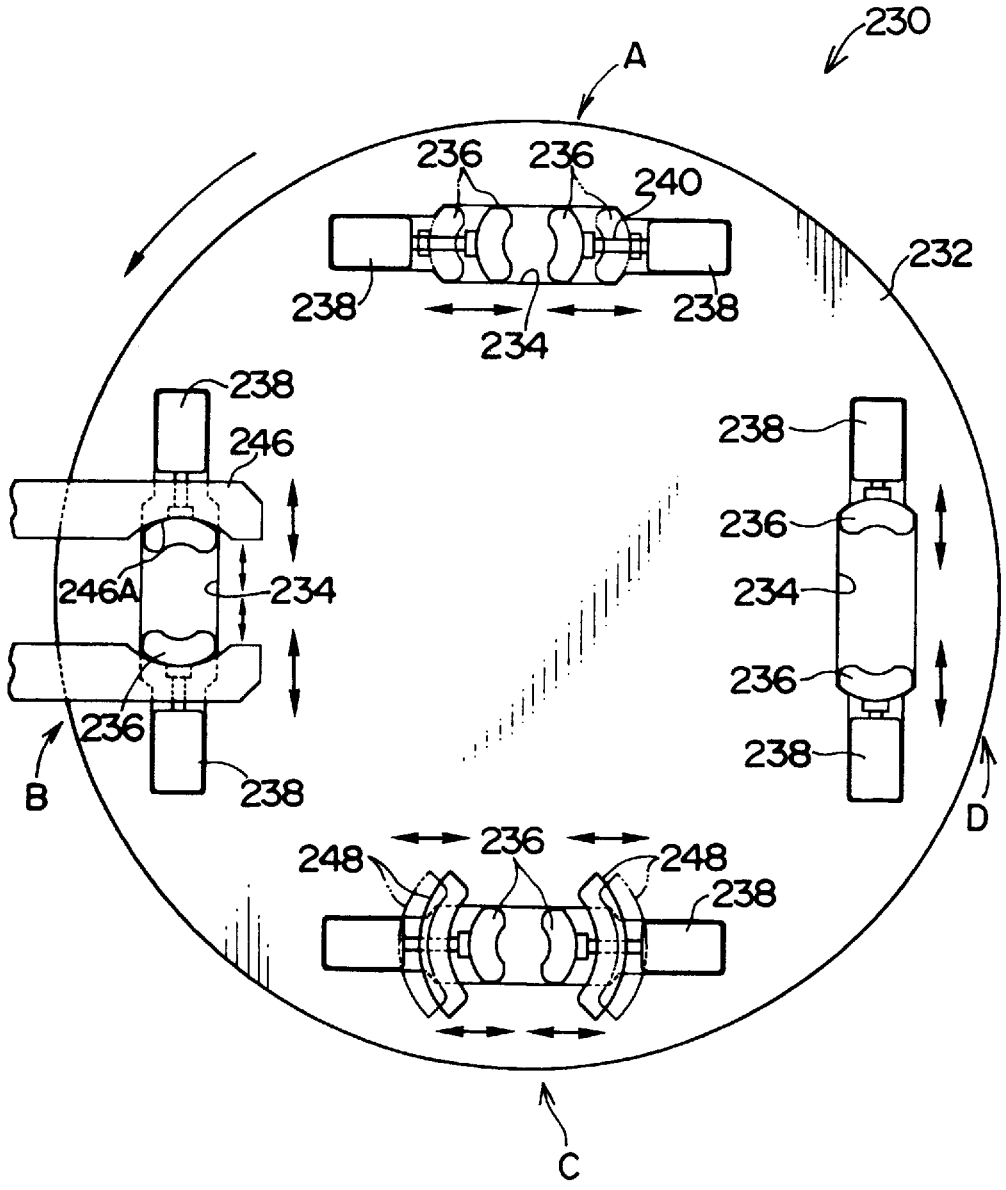
FIG. 17 is a plan view showing a production apparatus for the double curve formed products according to a second embodiment of the present invention.
Figure 18:
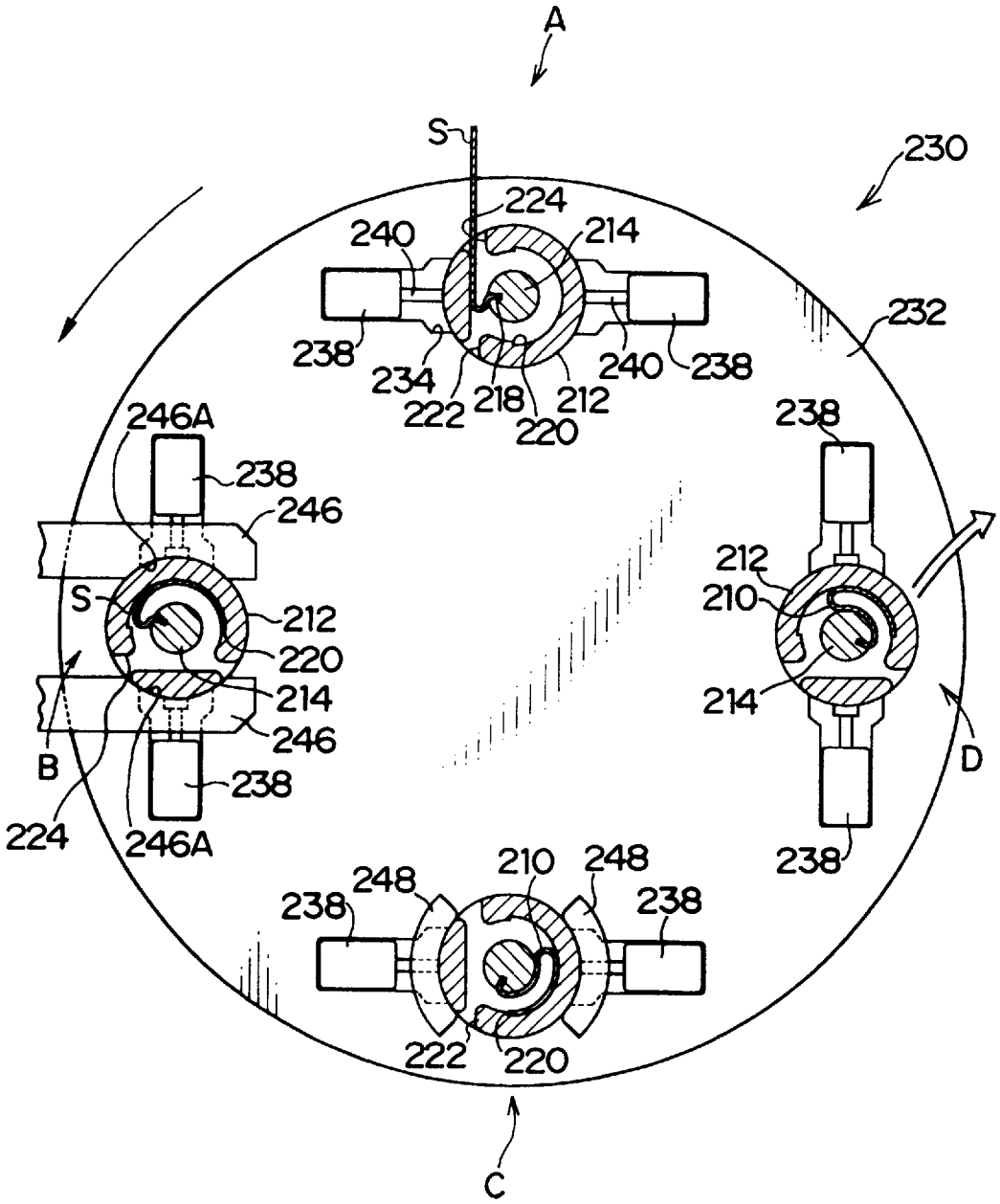
FIG. 18 is a plan view showing a state in which a spool and a shaft are set in a production apparatus for the double curve formed product according to the second embodiment.
Figure 20:
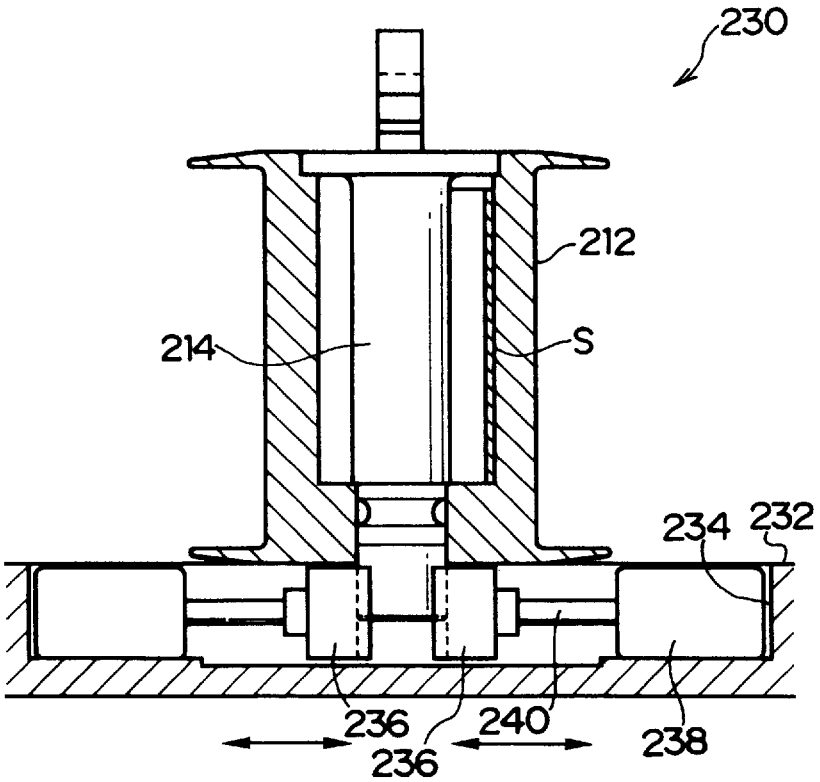
FIG. 20 is a sectional view of a production apparatus for the double curve formed product according to the second embodiment at the position A.

As shown in FIGS. 17, 18, 20, the production apparatus 230 has a circular turn table 232 which is rotated by a driving means (not shown). Four elongated grooves 234 having a smaller width than the external diameter of the spool 212 are formed in a peripheral portion of this turn table 232 at the same intervals. A pair of substantially semi-ring shaped hands 236 are slidably disposed in this elongated groove 234. The hands 236 are fixed to front ends of rods 240 of piston cylinders 238. The hands 236 which are pressed hold the shaft 214 which axially supports the spool 212 placed on the turn table 232 from both sides so as to position the shaft 214 in a center of the elongated groove 234 and fix the shaft 214 so that it cannot be rotated.

A disk (not shown) which is rotatable integrally with the turn table 232 is provided in the center of a rotation of the turn table 232. Four slits are formed at the same intervals on an external circumferential portion of this disk and positions of the slits are detected by means of a photo interrupter. Each time when the turn table 232 is turned at every 90° by signals transmitted from this photo interrupter, the spool 212 and the shaft 214 are controlled so as to be stopped at positions A, B, C, D.

Figure 21:
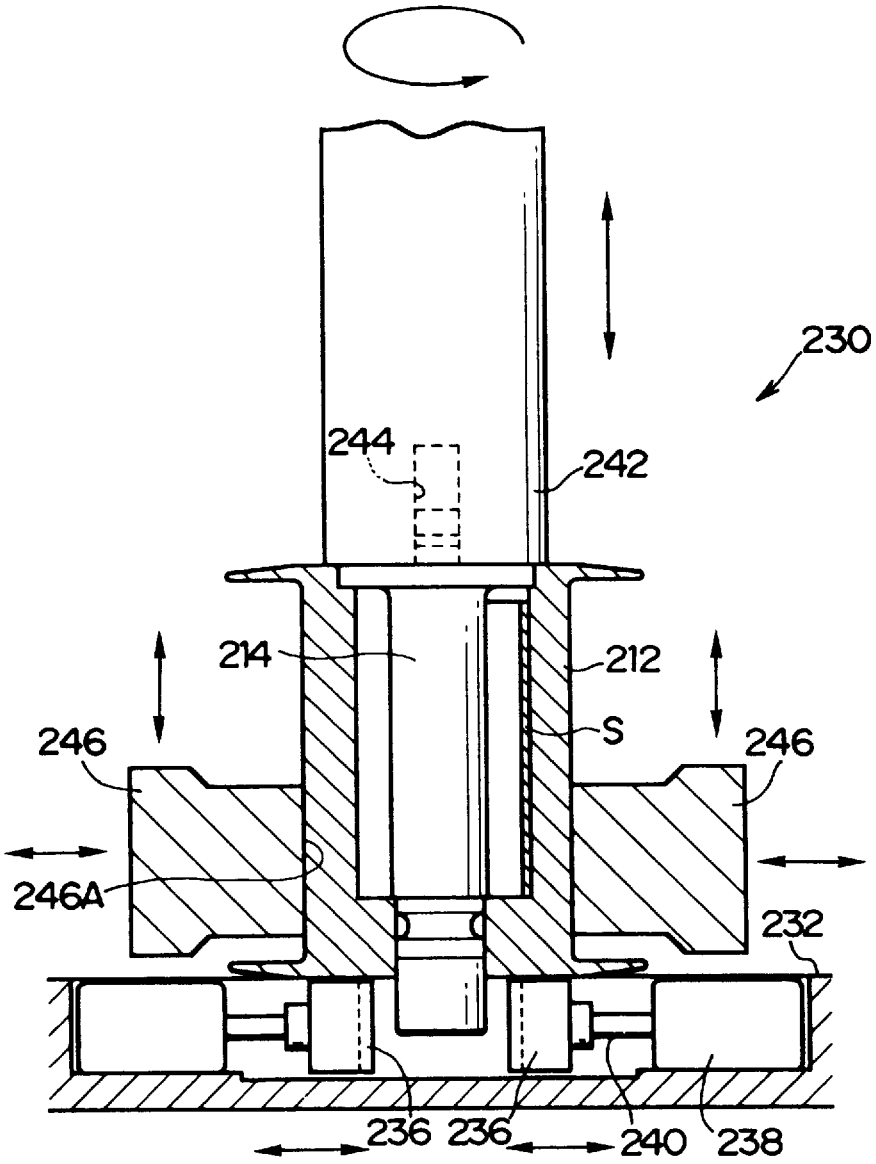
FIG. 21 is a sectional view of a production apparatus for the double curve formed product according to the second embodiment at the position B.

On the other hand, a driver 242 which is rotated by a motor (not shown) is disposed above the position B (see FIG. 21). This driver 242 descends and an engaging hole 244 is engaged with a top end of the shaft 214. Then, the shaft 214 is turned at about 270° counterclockwise.

Gripping arms 246 are disposed outside of the turn table 232. Gripping surfaces 246A of these gripping arms 246 are circularly curved so as to fit to an external shape of the spool 212 and grip the spool 212 unrotatably by moving the gripping arms 246 so as to approach each other. Meanwhile, the gripping arms 246 move upward when the turn table 232 is turned so as to retreat from above moving traces of the spool 212 and the shaft 214.

Figure 22:
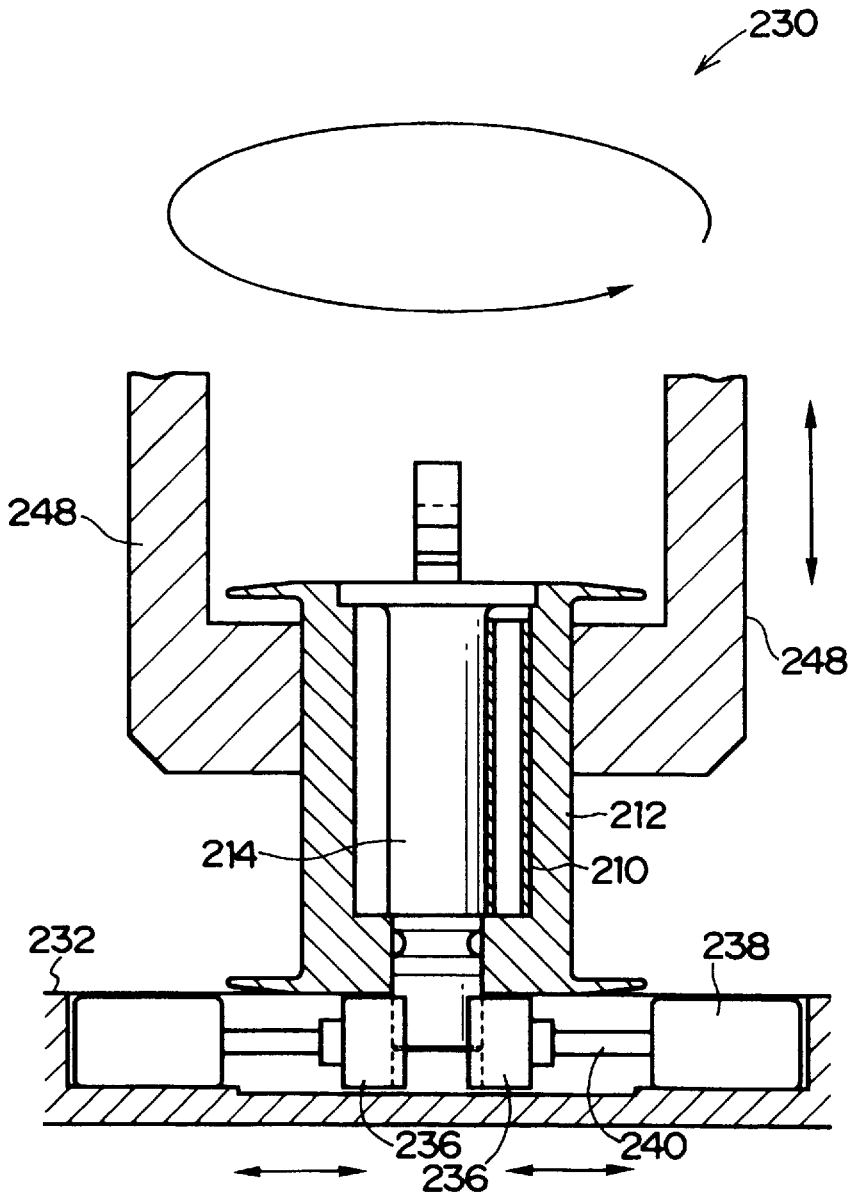
FIG. 22 is a sectional view of a production apparatus for the double curve formed product according to the second embodiment at the position C.

On the other hand, drive arms 248 which are rotated by a motor (not shown) are disposed above the position C (see FIG. 22). This drive arms 248 move downward, approach each other to grip side faces of the spool 212 and turn the spool 212 by about 180° counterclockwise.

Further, hands (not shown) for gripping the spool 212 and the shaft 214 from above the turn table 232 are disposed at the position D.

Then, an operation of the production apparatus 230 according to the second embodiment of the present invention will be described.

First, at the position A as shown in FIGS. 17, 18, 20, the spool 212 axially supported by the shaft 214 is placed on the turn table 232 such that a line connecting from the slit opening 222 to the slit opening 224 is perpendicular to the rod 240. Here, the piston cylinders 238 are driven to grip bottom ends of the shaft 214 by means of the hands 236 from both sides thereof, thereby positioning the shaft 214 in the center of the elongated groove 234 and fixing the shaft 214 so that it cannot be rotated.

Figure 19:
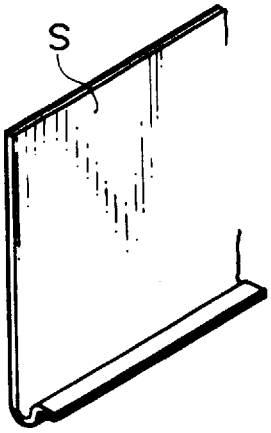
FIG. 19 is a perspective view showing a sheet material which is a material for the EA plate.

Next, as shown in FIG. 19, a sheet material S the front end of which is bent in a form of S letter (material of a double curve formed product) is inserted through the slit 224 and then engaged with the engaging groove 218 in the shaft 214.

Next, the turn table 232 is turned by 90° counterclockwise and stopped at the position B. Here, as shown in FIGS. 18 and 21, the gripping arms 246 descend, move so as to approach each other and fix the spool 212 so that it cannot be turned. Next, the driver 242 descends and the engaging hole 244 is engaged with the top end of the shaft 214. Next, the gripping condition of the hands 236 is released and the shaft 214 is turned by about 270° counterclockwise.

Consequently, the sheet material S is pulled into the shaft 214, bent along the internal circumferential surface of the spool 212 so as to be curved in a substantially semi-circular shape, and the rear end of the sheet material S is engaged with the engaging portion 220 in the spool 212. Here, the drivers 242 and the gripping arms 246 are moved upward and retreated from the moving traces of the spool 212 and the shaft 214.

Next, the turn table 232 is turned by 90° counterclockwise and stopped at the position C. As shown in FIGS. 18 and 22, the shaft 214 is fixed unrotatably by means of the hands 236. Then, the drive arms 248 move downward, approach each other to grip the sides of the spool 212 and turn the spool 212 by about 180° counterclockwise.

The rear end of the sheet material S curved in a substantially semi-circular shape is pressed by the engaging portion 220 and turned integrally with the spool 212. Then, the bent portion is folded back and the folded back portion is wound around the shaft 214. Consequently, the EA plate 210 is formed.

Figure 23:
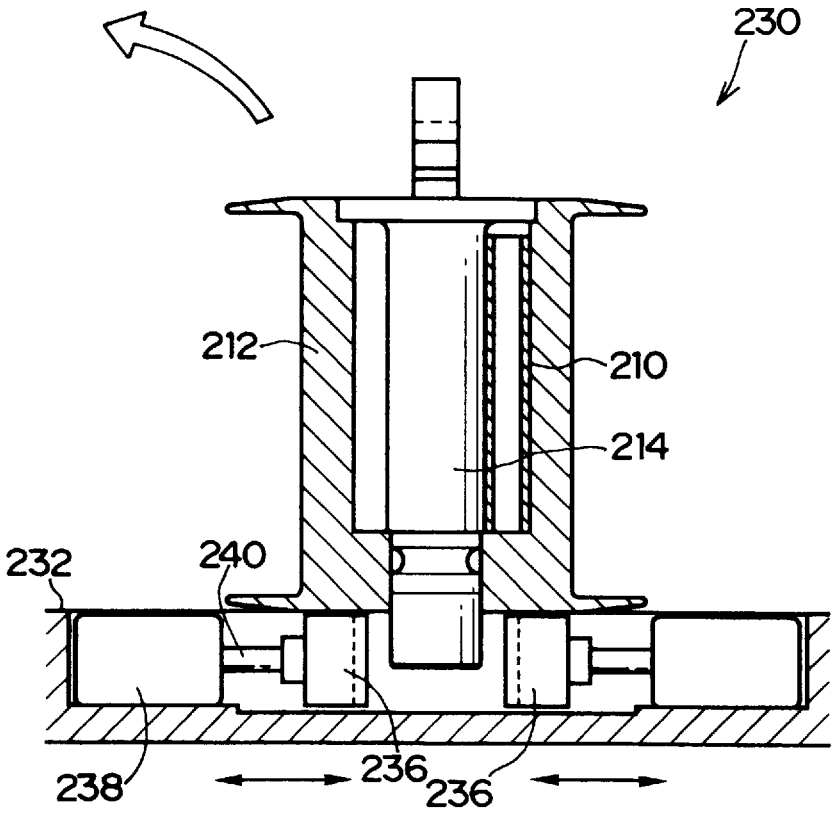
FIG. 23 is a sectional view of a production apparatus for the double curve formed product according to the second embodiment at the position D.

Next, the turn table 232 is turned by 90° counterclockwise and stopped at the position D. Here, as shown in FIGS. 18 and 23, the hands 236 are moved in such a direction that they are farther from each other. Then, the spool 212 and the shaft 214 in which the EA plate 210 is mounted are gripped by means of hands (not shown) and transferred from the turn table 232 to a storage box.

As described above, according to the second embodiment, the EA plate 210 which is a double curve formed product is assembled between the spool 212 and the shaft 214, thereby producing no error in accuracy in assembly and no effect upon functional characteristics of the products.

Although the second embodiment is so constructed that the turn table 232 is stopped at the respective positions and the shaft 214 and the spool 212 are turned by a rotating means disposed outside of the turn table 232, it is permissible that the turn table 232 is provided with a rotating means so that the EA plates 210 are processed during such a rotation.

Further, because the EA plate 210 can be processed by turning the spool 212 and the shaft 214 relative to each other, it is permissible that the spool 212 is fixed and then the shaft 214 is first turned counterclockwise and second, clockwise.

Next, a production apparatus 252 according to the third embodiment of the present invention will be described.

Figure 24:
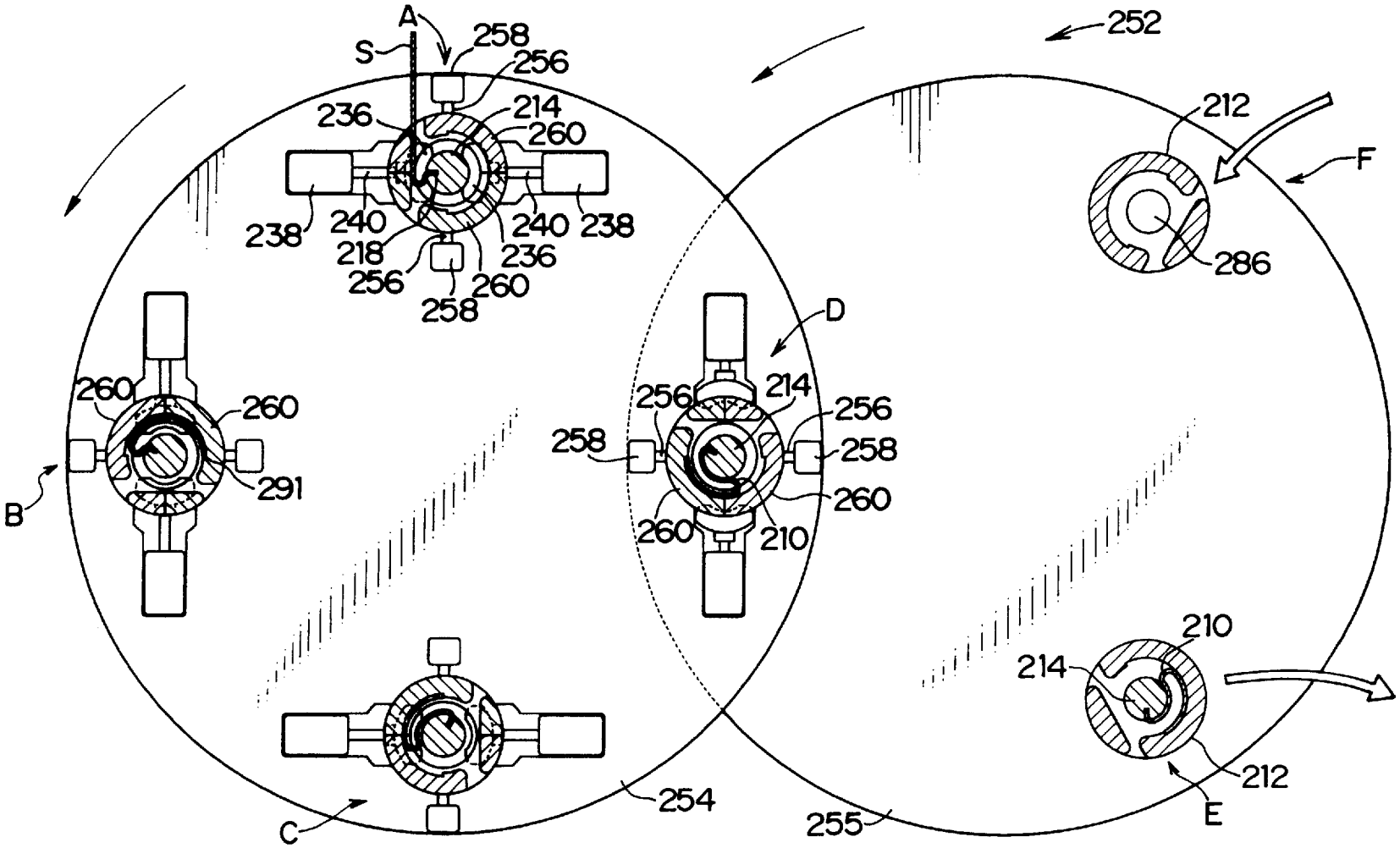
FIG. 24 is a plan view showing a production apparatus for the double curve formed product according to a third embodiment of the present invention.

As shown in FIG. 24, the production apparatus 252 according to the third embodiment comprises a turn table 254 for processing the EA plate 210 and a turn table 255 which is disposed below the turn table 254 so that an external peripheral portion thereof overlap that of the turn table 254.

As in the second embodiment, pairs of the hands 236 for fixing the shaft 214 are disposed at every 90° on the external peripheral portion of the turn table 254. Piston cylinders 258 are disposed so as to oppose each other on the turn table 254 such that they are perpendicular to the rods 240 for driving the hands 236.

Cases 260 having the same internal shape as the spool 212 placed on the turn table 255 when the cases 260 are fit to each other are fixed to the rods 256 of the piston cylinders 258. The cases 260 are separated by driving the piston cylinders 258. A through portion 290 having a slightly larger diameter than the internal diameter of the cases 260 is formed in the turn table 254 on an axial line of the cases 260 (see FIG. 26).

Figure 25:
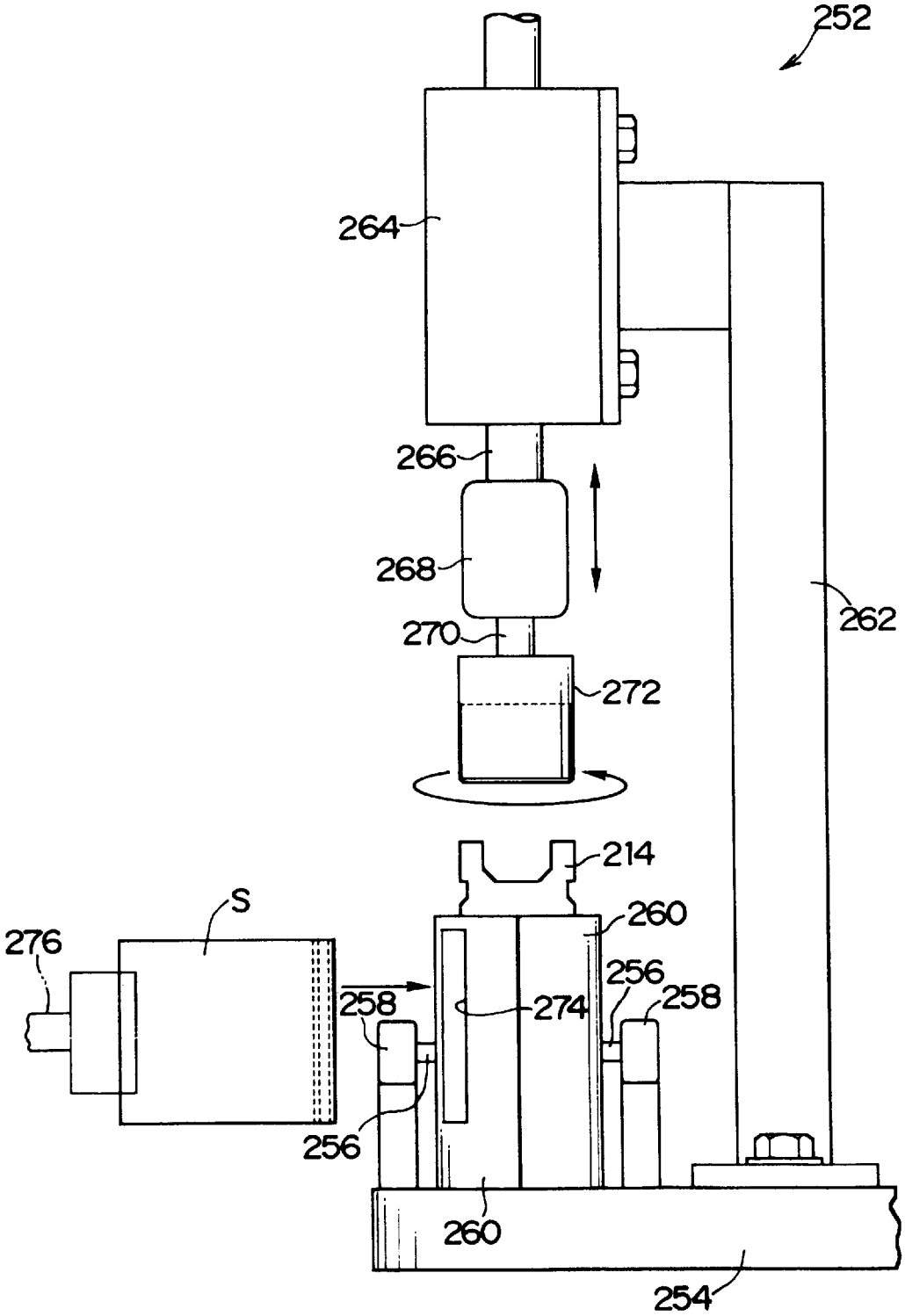
FIG. 25 is a side view of a production apparatus for the double curve formed product according to the third embodiment at the position A.

On the other hand, as shown in FIG. 25, a stand frame 262 is disposed vertically on the turn table 254. A cylinder 264 is installed on a top portion of the stand frame 262 and a motor 268 is fixed to a front end of the rod 266. A driver 272 which is engageable with the top end of the shaft 214 is installed to a revolving shaft 270 of this motor 268. Further, an arm 276 for gripping the sheet material S and forcing it into a slit opening 274 in the case 260 is disposed at the position A.

Figure 26:
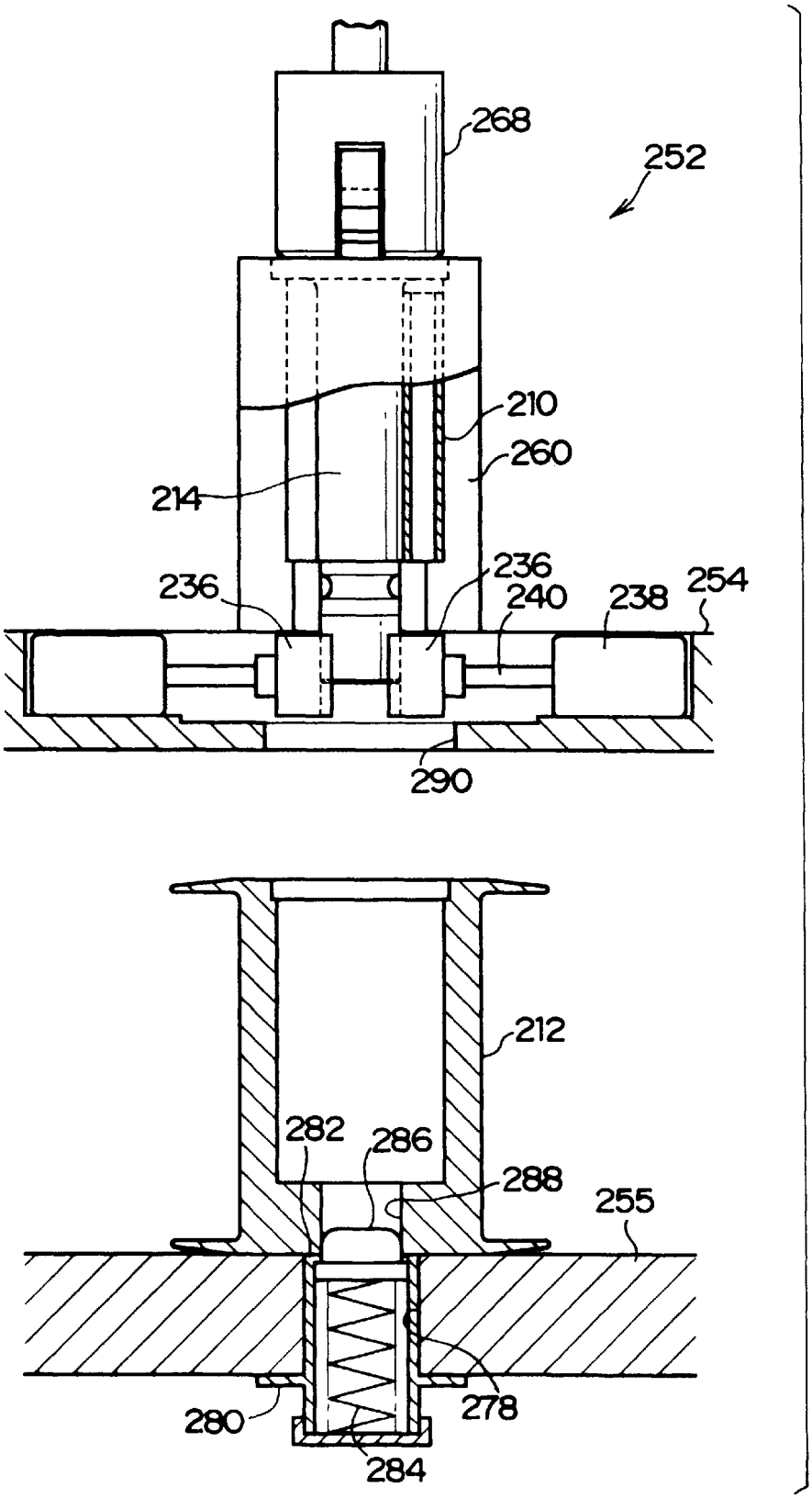
FIG. 26 is a sectional view showing movement of the production apparatus for the double curve formed product according to the third embodiment at the position D.

As shown in FIGS. 24 and 26, mounting holes 278 are drilled at every 120° in the turn table 255. A cap 280 is fit to this mounting hole 278. A tubular flange 282 extends to a center thereof in an opening portion of this cap 280 to prevent a holding pin 286 urged by a spring 284 disposed in the cap 280 upward from slipping out of the cap 280.

Usually, the holding pin 286 is protruded from a mounting surface of the turn table 255 and engageable with an axial supporting hole 288 in the spool 212.

Next, an operation of a production apparatus 252 according to the third embodiment of the present invention will be described below.

First, at the position A as shown in FIG. 25, the piston cylinders 258 press each other so that the cases 260 are fit to each other. The shaft 214 is inserted into the cases 260 and the bottom end portions thereof are gripped by the hands 236, so that the shaft 214 is positioned in the center of the cases 260 and the shaft 214 and the cases 260 are fixed unrotatably.

Next, as shown in FIG. 25, the arm 276 is activated to insert the sheet material S through the slit opening 274 in the case 260, so that an front end thereof is engaged with the engaging groove 218 in the shaft 214.

Next, until the turn table 254 turns counterclockwise and reaches the position D, first the driver 272 descends and is engaged with a top end portion of the shaft 214. Next, the motor 268 is driven to turn the driver 272, thereby turning the shaft 214 by about 270° counterclockwise. Consequently, the sheet material S is pulled into the shaft 214, bent along the internal circumferential surface of the cases 260 so that it is curved in a substantially semi-circular shape and a rear end portion thereof is engaged with the engaging portion 291 of the cases 260 in the vicinity of the position B.

Next, the driver 272 is driven to turn the shaft 214 by about 180° clockwise. Consequently, the sheet material S curved in a substantially semi-circular shape is folded back from a front end thereof and wound up around the shaft 214. As a result, the EA plate 210 is formed in the vicinity of the position C.

Next, the turn table 254 is stopped at the position D. By this time, the axial supporting hole 288 in the spool 212 has fitted to the holding pin 286 protruding from the turn table 255 and been fixed thereto. Then, the spool 212 has been moved to the position D.

Figure 27:
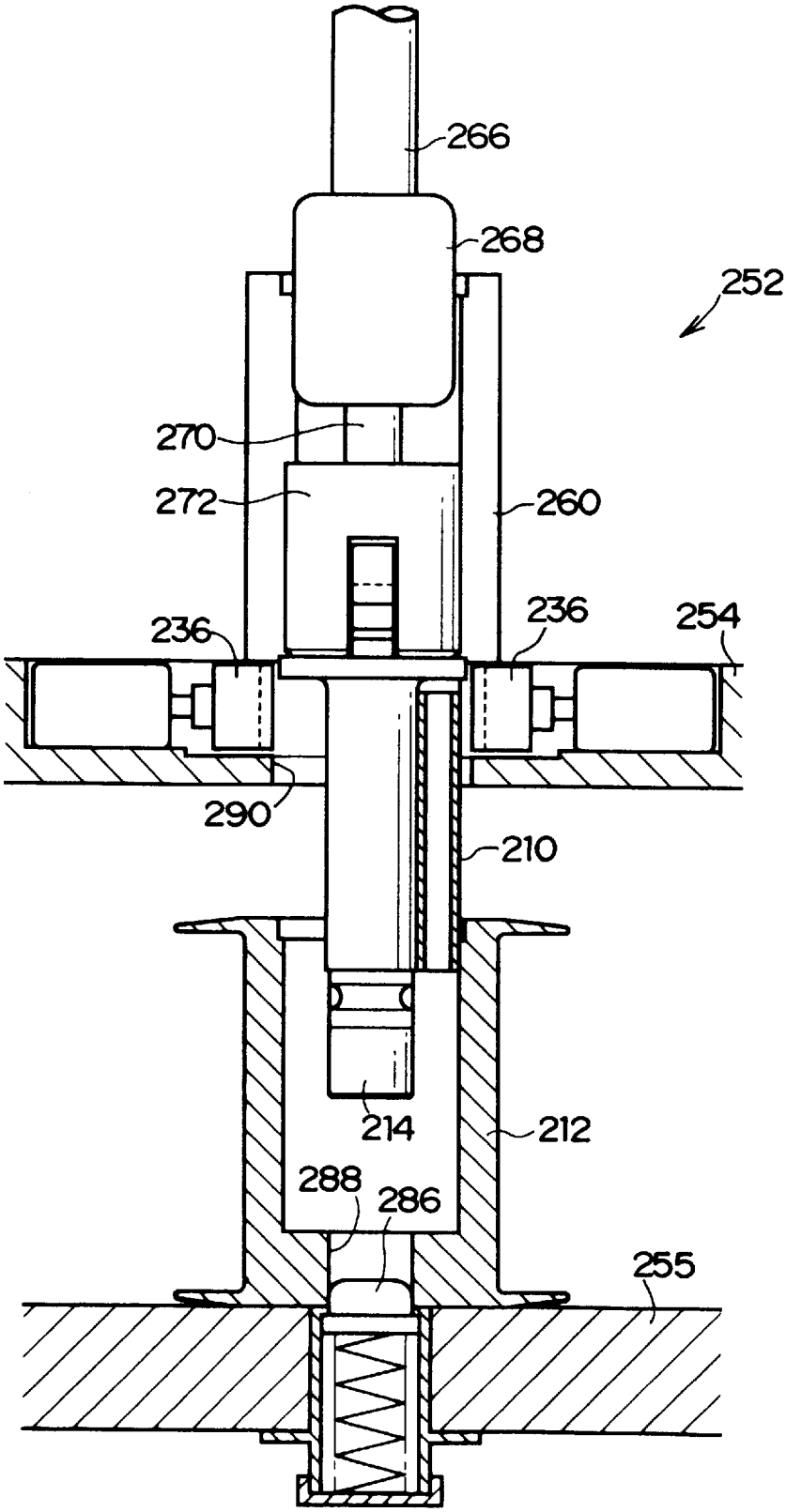
FIG. 27 is a sectional view showing movement of the production apparatus for the double curve formed product according to the third embodiment at the position D.

Here, as shown in FIGS. 26 and 27, the rods 256 are retracted to separate the cases 260 (FIG. 27 shows a state in which the cases 260 have been separated in a direction of the front and rear of this drawing). The hands 236 are opened to release the gripping condition of the shaft 214 and at the same time, the cylinder 264 is driven to force the shaft 214 through the through portion 290 by means of the driver 272.

At this time, the turn table 255 has been turned and stopped such that the spool 212 is positioned on an axial line of the through portion 290.

Figure 28:
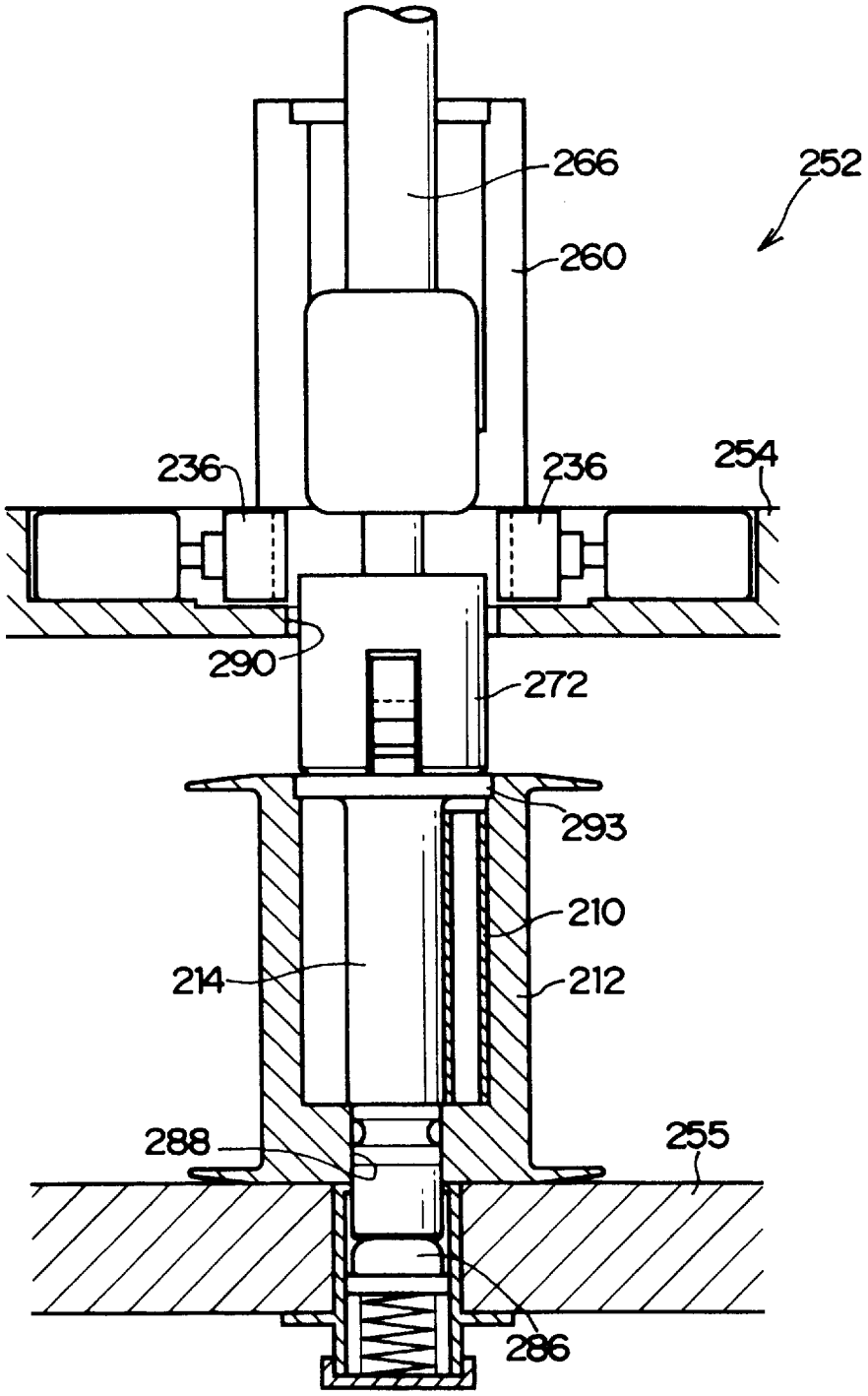
FIG. 28 is a sectional view showing movement of the production apparatus for the double curve formed product according to the third embodiment at the position D.

As shown in FIG. 28, if the shaft 214 is pressed further, the shaft 214 goes through the through portion 290 while forcing down the holding pin 286 and finally is incorporated in the cavity portion in the spool 212 together with the EA plate 210. Here, if the driver 272 is retracted upward, the turn table 255 is turned counterclockwise, so that the spool 212 in which the shaft 214 and the EA plate 210 are incorporated is taken out of the turn table at the position E.

As described above, by processing the sheet material S by utilizing the cases 260 for bending work, having the same shape as the spool 212 which is a target product and having a large strength, even if the strength of the spool 212 which is a completed product is small, it is possible to assemble the double curve formed product having a high accuracy in configurational dimension thereinto.

Next, the cases 260 from which the shaft 214 and the EA plate 210 were removed at the position D are pressed by the piston cylinders 258 and fit to each other during a move up to the position A by a turn of the turn table 254 and then, the shaft 214 and the sheet material S are loaded in between the cases 260.

In this embodiment, the EA plates 210 are processed by using the shaft 214 provided with the flange 293 at an end thereof (see FIG. 28). Thus, it is necessary to separate the cases 260 vertically in this case. However, if a cylindrical shaft having no flange is utilized, it is not necessary to separate the case 260 when the shaft is removed, and therefore a cylindrical case can meet such a requirement.

Further, this embodiment has indicated a case in which the shaft 214 is turned clockwise or counterclockwise by means of the driver 272. However, it is permissible to so construct that the shaft 214 is fixed and the cases 260 are turned by utilizing a means like the drive arm 248 previously mentioned in the second embodiment.

Because the present invention is constructed as described above, special equipment and dies are not required, and a number of production steps can be reduced, thereby making it possible to stabilize an accuracy in configurational dimension. Further, an accuracy in assembly of the product can be improved.

While the embodiments of the present invention, as herein disclosed, constitute a preferred form, it is to be understood that other forms might be adapted.

What is claimed is:

1. A production method for double curve formed products in which an internal curved portion thereof and an external curved portion thereof are connected with each other integrally at one end and have a separating distance therebetween, said production method comprising:

engaging one end portion of a sheet shaped treatment product with an inner die;

engaging the other end portion of said sheet shaped treatment product with an outer die which is rotated around said inner die relative thereto;

rotating said inner die and said outer die relative to each other at a predetermined angle with one end of said treatment product fed along a processing curved surface of said outer die, said treatment product being folded back successively from a middle portion thereof to form said internal curved portion along a processing curved surface of said inner die, said internal curved portion being disposed inside of said external curved portion along said outer die.

2. A production method for the double curve formed products as claimed in claim 1 further comprising:

engaging said one end portion of said sheet shaped treatment product with a concave portion formed in the inner die in a longitudinal direction thereof, said inner die being of a cylindrical shape;

disposing said inner die in a cylindrical cavity portion of said outer die coaxially therewith, said outer die being of a cylindrical shape, said cylindrical cavity portion comprising a first cavity portion which is a semi-circular shape having a radius which is a first length and a second cavity portion which is a semi-circular shape having a radius which is a second length larger than said first length; and engaging said other end portion of said treatment product with a difference in step between said first cavity portion and said second cavity portion.

3. A production apparatus for double curve formed products in which an internal curved portion thereof and an external curved portion thereof are connected with each other integrally at one end and have a separating distance therebetween, said production apparatus comprising:

an inner die having an engaging portion for engaging an end portion of a sheet shaped treatment product, and an external processing curved surface provided on an external circumferential surface portion continuous from said engaging portion;

an outer die having an engaging portion for engaging the other end portion of said treatment product, and an internal processing curved surface provided on an internal circumferential surface portion continuous from said engaging portion, said outer die being coaxially and rotatably mounted outside of said inner die; and a rotation driving means for rotating said outer die in which said one end of said treatment product is engaged and said outer die in which said other end portion of said treatment product is engaged, relative to each other in such a direction that a middle portion of said treatment product is folded back, to plastically deform said middle portion of said treatment product so as to be along the processing curved surface of said inner die.

4. A production apparatus for the double curve formed products as claimed in claim 3 wherein said inner die is of a cylindrical shape, an external circumferential surface of said cylindrical shape forming said external processing curved surface of said inner die, said engaging portion in said inner die for engaging said one end portion of said sheet shaped treatment product being a concave portion formed in a longitudinal direction of said inner die of said cylindrical shape; and said outer die is of a cylindrical shape, said inner die being disposed in a cavity portion of said cylindrical shape coaxially therewith, said cylindrical cavity portion comprising a first cavity portion which is a semi-circular shape having a radius which is a first length and a second cavity portion which is a semi-circular shape having a radius which is a second length larger than said first length, a difference in step between said first cavity portion and said second cavity portion forming said engaging portion in said outer die for engaging said other end portion of said treatment product, an internal circumferential surface of said second cavity portion forming said internal processing curved surface.

5. A production apparatus for double curve formed products in which an internal curved portion thereof and an external curved portion thereof are connected with each other integrally at one end and have a separating distance therebetween, said production apparatus comprising:

an inner die in which an engaging portion for engaging an end portion of a treatment product formed in a circular sheet shape is provided in a part of an external circumferential surface which serves for a processing curved surface for said treatment product;

an outer die in which an engaging portion for engaging the other end portion of said treatment product is provided in a part of an internal circumferential surface which serves for a processing curved surface for said treatment product, said outer die being mounted out of said inner die rotatably therearound coaxially with said inner die; and a rotation driving means for rotating said outer die in which said other end portion of said treatment product is engaged, with respect to said inner die in which said one end of said treatment product is engaged, in such a direction that a middle portion of said treatment product is folded back, to plastically deform said treatment product so as to be along the processing curved surface of said inner die.

6. A production apparatus for the double curve formed products as claimed in claim 5 wherein said inner die is of a cylindrical shape, said engaging portion in said inner die for engaging said one end of said sheet shaped product being a concave portion formed in a longitudinal direction of said inner die of said cylindrical shape; and said outer die is of a cylindrical shape, said inner die being disposed in a cavity portion of said cylindrical shape coaxially therewith, said cylindrical cavity portion comprising a first cavity portion which is a semi-circular shape having a radius which is a first length and a second cavity portion which is a semi-circular shape having a radius which is a second length larger than said first length, a difference in step between said first cavity portion and said second cavity portion forming said engaging portion in said outer die for engaging said other end portion of said treatment product.

7. A production method for double curve formed products, comprising:

a first step in which a front end of a sheet material is inserted into an engaging groove in a shaft inserted so as to form an annular cavity portion in a cylindrical body in which an opening is formed on a side face thereof, said sheet being inserted through said opening to engage said front end of said sheet material into said engaging groove;

a second step in which said cylindrical body and said shaft are rotated relative to each other in a single direction until a rear end of said sheet material is engaged with an engaging portion formed in an internal circumferential surface of said cylindrical body; and a third step in which said cylindrical body and said shaft are rotated relative to each other in a direction different from said single direction.

8. A production method for the double curve formed products as claimed in claim 7 wherein said cylindrical body and said shaft are utilized as a completed product after said third step is finished, said double curve formed product is automatically assembled in a completed product.

9. A production method for the double curve formed products as claimed in claim 7 wherein said cylindrical body is fixed and said shaft is rotated in said second step, and said shaft is fixed and said cylindrical body is rotated in said different direction.

10. A production method for the double curve formed products as claimed in claim 7 wherein the shaft and the double curve formed product are removed from said cylindrical body and loaded into another cylindrical body after said third step is finished.

11. A production method for the double curve formed products as claimed in claim 7 wherein said cylindrical body is fixed and said shaft is rotated in a single direction in said second step and said shaft is rotated in an opposite direction to said single direction of said shaft in said third step.

12. A production method for the double curve formed products as claimed in claim 10 wherein said another cylindrical body is a cylindrical body which is a product having the same configuration as said cylindrical body.

* * * * *